US010025214B2

(12) United States Patent
Nagayama et al.

(10) Patent No.: US 10,025,214 B2
(45) Date of Patent: Jul. 17, 2018

(54) CARRIER, DEVELOPING AGENT, IMAGE FORMING APPARATUS, IMAGE FORMING METHOD, REPLENISHMENT TONER, AND PROCESS CARTRIDGE

(71) Applicants: Masashi Nagayama, Shizuoka (JP); Mariko Takii, Kanagawa (JP); Yoshihiro Murasawa, Shizuoka (JP); Haruki Murata, Kanagawa (JP); Kei Niwayama, Shizuoka (JP); Tohru Suganuma, Shizuoka (JP); Koichi Sakata, Shizuoka (JP); Saori Yamada, Shizuoka (JP); Shinya Nakagawa, Shizuoka (JP); Kohsuke Miyazaki, Shizuoka (JP)

(72) Inventors: Masashi Nagayama, Shizuoka (JP); Mariko Takii, Kanagawa (JP); Yoshihiro Murasawa, Shizuoka (JP); Haruki Murata, Kanagawa (JP); Kei Niwayama, Shizuoka (JP); Tohru Suganuma, Shizuoka (JP); Koichi Sakata, Shizuoka (JP); Saori Yamada, Shizuoka (JP); Shinya Nakagawa, Shizuoka (JP); Kohsuke Miyazaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/392,482

(22) Filed: Dec. 28, 2016

(65) Prior Publication Data

US 2017/0185000 A1 Jun. 29, 2017

(30) Foreign Application Priority Data

Dec. 28, 2015 (JP) ..... 2015-257105
Nov. 25, 2016 (JP) ..... 2016-229173

(51) Int. Cl.
*G03G 9/113* (2006.01)
*G03G 15/08* (2006.01)
(Continued)

(52) U.S. Cl.
CPC ..... *G03G 9/1139* (2013.01); *G03G 9/0833* (2013.01); *G03G 9/1131* (2013.01);
(Continued)

(58) Field of Classification Search
CPC ..... G03G 9/1131; G03G 9/1139
See application file for complete search history.

(56) References Cited

U.S. PATENT DOCUMENTS 5,312,614 A * 5/1994 Hayashi ..... H01B 1/08 106/425
6,500,595 B1 12/2002 Mochizuki et al.
(Continued)

FOREIGN PATENT DOCUMENTS

EP 1162511 A2 * 12/2001 ..... G03G 9/0906
JP 54-155048 12/1979
(Continued)

OTHER PUBLICATIONS

English language machine translation of JP 8-286429 (Nov. 1996).*
(Continued)

*Primary Examiner* — Christopher D Rodee
(74) *Attorney, Agent, or Firm* — Oblon, McClelland, Maier & Neustadt, L.L.P.

(57) ABSTRACT

Carrier for image forming includes a core material particle including a magnetic material and a coating layer disposed on the surface of the core material particle, the coating layer including a resin, carbon black, an inorganic particulate A, and an inorganic particulate B. The carbon black has a concentration gradient along a thickness direction of the coating layer with a concentration from high to low toward
(Continued)

a surface of the coating layer while the inorganic particulate A has a concentration gradient along a thickness direction of the coating layer with a concentration from low to high toward the surface of the coating layer. The volume ratio of the carbon black is 0-30 percent at a depth range of 0.0-0.1 μm from the surface of the coating layer. The inorganic particulate A is electroconductive with a powder specific resistance of 200 Ω·cm or less.

10 Claims, 10 Drawing Sheets

(51) Int. Cl.
*G03G 9/083* (2006.01)
*G03G 15/01* (2006.01)

(52) U.S. Cl.
CPC ..... *G03G 15/0121* (2013.01); *G03G 15/0865* (2013.01); *G03G 2215/0129* (2013.01); *G03G 2215/0132* (2013.01)

(56) References Cited

U.S. PATENT DOCUMENTS

| | | | | |
|---|---|---|---|---|
| 7,968,267 | B2 * | 6/2011 | Maeyama | G03G 15/081 399/253 |
| 2002/0015905 | A1 * | 2/2002 | Isonaka | G03G 9/0906 430/111.35 |
| 2002/0055052 | A1 * | 5/2002 | Komoto | G03G 9/0821 430/108.22 |
| 2003/0219670 | A1 | 11/2003 | Sawada et al. | |
| 2004/0157147 | A1 | 8/2004 | Shiraishi et al. | |
| 2004/0234879 | A1 | 11/2004 | Hasegawa et al. | |
| 2005/0277046 | A1 | 12/2005 | Sawada et al. | |
| 2007/0298339 | A1 * | 12/2007 | Kozuru | G03G 9/113 430/55 |
| 2008/0213682 | A1 | 9/2008 | Saitoh et al. | |
| 2012/0237868 | A1 | 9/2012 | Yamada et al. | |
| 2012/0251168 | A1 | 10/2012 | Nagayama et al. | |
| 2013/0244162 | A1 | 9/2013 | Yamada et al. | |
| 2013/0260299 | A1 | 10/2013 | Nakajima et al. | |
| 2013/0260302 | A1 | 10/2013 | Nakajima et al. | |
| 2015/0030819 | A1 | 1/2015 | Naito et al. | |
| 2015/0253685 | A1 | 9/2015 | Suzuki et al. | |
| 2016/0327884 | A1 | 11/2016 | Nakajima et al. | |
| 2016/0363880 | A1 | 12/2016 | Takii et al. | |

FOREIGN PATENT DOCUMENTS

| | | |
|---|---|---|
| JP | 56-075659 | 6/1981 |
| JP | 57-040267 | 3/1982 |
| JP | 57-168255 | 10/1982 |
| JP | 58-108548 | 6/1983 |
| JP | 58-108549 | 6/1983 |
| JP | 58-117555 | 7/1983 |
| JP | 59-166968 | 9/1984 |
| JP | 2-079862 | 3/1990 |
| JP | 3-073968 | 3/1991 |
| JP | 4-360156 | 12/1992 |
| JP | 5-273789 | 10/1993 |
| JP | 5-303238 | 11/1993 |
| JP | 6-202381 | 7/1994 |
| JP | 8-006307 | 1/1996 |
| JP | 8-179570 | 7/1996 |
| JP | 8-286429 | 11/1996 |
| JP | 11-174740 | 7/1999 |
| JP | 2001-117287 | 4/2001 |
| JP | 2011-158833 | 8/2011 |

OTHER PUBLICATIONS

Diamond, Arthur S (editor) Handbook of Imaging Materials. New York: Marcel-Dekker, Inc. (2002) pp. 145-164.*
Borsernberger, P.M.; Weiss, D. Organic Photoreceptors for Imaging Systems. New York: Marcel-Dekker, Inc. (1993) pp. 6-17.*

* cited by examiner

CARRIER, DEVELOPING AGENT, IMAGE FORMING APPARATUS, IMAGE FORMING METHOD, REPLENISHMENT TONER, AND PROCESS CARTRIDGE

CROSS-REFERENCE TO RELATED APPLICATIONS

This patent application is based on and claims priority pursuant to 35 U.S.C. § 119 to Japanese Patent Application Nos. 2015-257105 and 2016-229173, filed on Dec. 28, 2015 and Nov. 25, 2016, respectively, in the Japan Patent Office, the entire disclosures of which are hereby incorporated by reference herein.

BACKGROUND

Technical Field

The present invention relates to carrier for image forming, a developing agent, an image forming apparatus, an image forming method, replenishment toner, and a process cartridge.

Description of the Related Art

In general, in image forming methods employing electrophotography, electrostatic imaging, etc., developing agents obtained by stirring and mixing toner and carrier are used to develop latent electrostatic images formed on a latent image bearer. This developing agent is required to be a suitably-charged mixture.

To develop such latent electrostatic images, there are two known methods, one of which uses a two-component developing agent obtained by mixing toner and carrier, the other, a single-component developing agent including no carrier.

The friction charging area to toner is large due to the usage of carrier in the two-component development method. Therefore, charging properties are stable in comparison with the single-component method, which is advantageous in order to maintain the image quality for an extended period of time. In addition, the capability of supplying toner to the development area is high. For this reason, the two-component method is employed in particularly high-end apparatuses. Moreover, in digital electrophotographic system to form a latent electrostatic image on a photoconductor with a laser beam and render the latent electrostatic image visible, the two-component development method is widely adopted taking into such advantages.

The granular carrier for use in the two-component development method has been improved to prevent toner spent on the surface of the carrier, render the carrier to have a uniform surface, prevent oxidization of the surface, suppress degradation of moisture sensitivity, prolong working life of the developing agent, protect a photoconductor from being scarred or abrasion caused by the carrier, and control charging polarity and the charging size to ameliorate durability. For example, carrier covered with a particular resin material, carrier in which various additives are added to the coating resin, carrier having a surface to which an additive is attached have been proposed. In addition, a carrier coating material including a guanamine resin and a thermocuring resin cross-linkable with the guanamine resin and a carrier coating material including cross-linked matter of a melamine resin and an acrylic resin have been proposed.

Moreover, aiming for improving durability, carrier having a resin layer including a resin component in which a thermocuring resin and a guanamine resin are cross-linked and a charge control agent has been proposed. Such a resin layer is resilient enough to absorb friction with toner during stirring with toner to triboelectrically charge the developing agent or a hard shock to the coating resin caused by friction between carrier particles. For this reason, toner spent on the carrier is suppressed.

However, demand for carrier having higher level of durability is still strong on the market.

Resin coating renders the resin coated carrier insulated, which prevents the carrier from serving as a development electrode. Therefore, in particular, edge effect tends to particularly occur at solid image portion. Furthermore, since counter charge at the time of toner detachment is excessive, carrier attachment to non-imaging portion due to electrostatic development easily occurs. In an attempt to dissolve this issue, for example, resin coated carrier having a coating layer in which electroconductive carbon is dispersed as an electroconductive agent has been proposed.

However, due to friction and collision between carrier particles or carrier and toner, carbon or resin pieces including carbon are detached from such a carrier coating layer. As a result, these adhere to toner particles or are used for development meaninglessly as they are. To form a photocopying image of black texts, etc. using black toner, this phenomenon does not create a large problem. However, this arises as a significant problem such as color cloudiness or color contamination in a developing agent in combination with color toner, in particular, yellow toner, white toner, or transparent toner.

Carrier including electroconductive fillers in a carrier coating layer has been also proposed. Such carrier uses the electroconductive filler as the electroconductive particulate other than carbon. Therefore, it is possible to select less colored material to reduce an impact of colored material detached from the carrier on toner. However, the introduction of the carrier is to improve image quality by electrical stability of the electroconductive filler. Moreover, there is no mention about the color of the electroconductive filler. That is, the inclusion of the electroconductive filler is not a complete problem-solving approach to the color contamination mentioned above.

Also, carrier having an inner layer including carbon black and an outer layer including only a resin has been proposed. Since the outer layer of this carrier is coated with only a resin, contamination of toner occurs less when the coating layer is scraped.

Carrier has been proposed, which includes a resin coating layer having a concentration gradient of carbon black with a concentration from high to low from the inner side to the surface of the resin coating layer where no carbon black is present.

However, since the amount of carbon black, which serves as an only resistance control agent in such carrier, changes on the inner side and on the surface side, the carrier resistance changes as the coating layer is scraped, so that the image quality changes over time.

In addition, carrier including a layer including carbon black and a coating layer including a white-base electroconductive agent disposed on the carbon black layer have been proposed. Such carrier does not seem to significantly suffer toner contamination or a change of carrier resistance caused by scraping off of the surface of the coating layer. However, since no measures is taken to suppress scraping-off of the coating layer, the coating layer including the white electroconductive agent is easily scraped off. For this reason, if the layer including carbon black is exposed as a result of use for an extended period of time, toner contamination occurs.

Therefore, a measures to provide stable image quality for an extended period of time has been demanded while suppressing detachment from the surface of carrier and causing no color contamination even if the detachment occurs.

SUMMARY

According to the present invention, provided is an improved carrier for image forming including a core material particle including a magnetic material and a coating layer disposed on the surface of the core material particle, the coating layer including a resin, carbon black, an inorganic particulate A, and an inorganic particulate B. The carbon black has a concentration gradient along a thickness direction of the coating layer with a concentration from high to low toward a surface of the coating layer while the inorganic particulate A has a concentration gradient along a thickness direction of the coating layer with a concentration from low to high toward the surface of the coating layer. The volume ratio of the carbon black is 0-30 percent at a depth range of 0.0-0.1 μm from the surface of the coating layer. The inorganic particulate A is electroconductive with a powder specific resistance of 200 Ω·cm or less.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
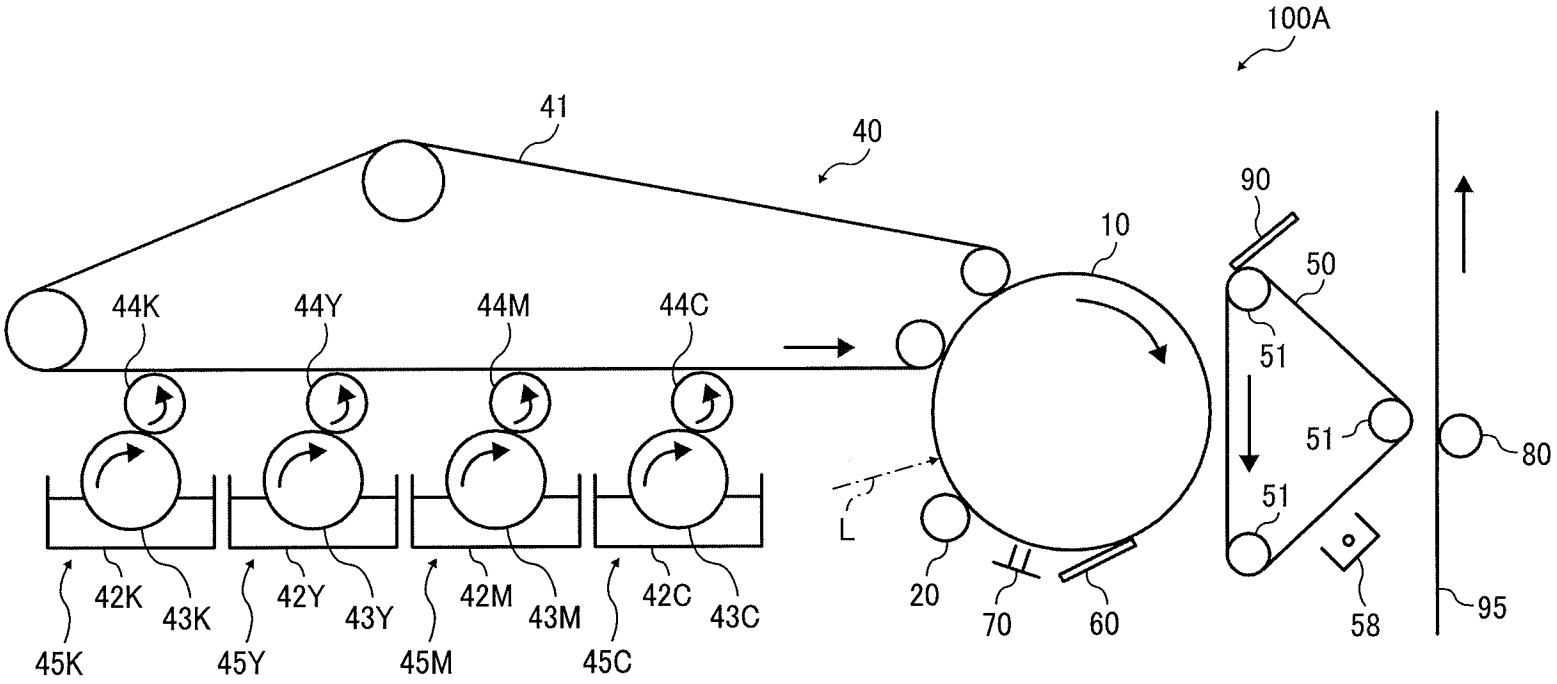
FIG. 1 is a schematic diagram illustrating an example of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning.

The present invention is described in detail below.

It is to be noted that although the embodiments described below are preferred embodiments described with various technically preferred limitations, and the present invention is not limited thereto unless otherwise described.

As a result of an investigation made by the present inventors, it was found that, while prescribing carbon black having an excellent resistance control ability in a coating layer to coat a core particle, the amount of carbon black is reduced toward the surface of the coating layer to reduce the amount of carbon black contained in the coating composition isolated from the carrier when the coating layer is scraped off, so that occurrence of color contamination to toner is controlled. In addition, for the concern that the electric resistance at a position close to the surface is increased due to the reduction of carbon black, the inorganic particulate A having electroconductivity is prescribed more towards the surface where carbon black is less. Therefore, the electric resistance on the surface side has the same electric resistance as on the inner side where the concentration of carbon black is thick.

In terms of suppression of color contamination, the amount of carbon black on the uppermost surface is ideally zero. However, carbon black has a particle diameter. Therefore, a coating layer including no carbon black is required to be thick in order to contain no carbon black on the uppermost surface. This leads to an increase of usage of the inorganic particulate A, which is electroconductive. To suppress color contamination, it is preferable to use color as light as possible for the inorganic particulate A. However, light color electroconductive materials are typically made of rare earths. In light of resource protection, it is preferable to decrease the amount of the inorganic particulate A while allowing a minute amount of carbon black present on the surface of the coating layer of carrier as long as the color contamination is ignorable.

Based on this technological concept, the present inventors have made an investigation on suitable existing ratio of carbon black. As a consequence, if carbon black is present in an amount of about 30 percent by volume in the depth range of 0.0-0.1 μm from the surface of the carrier coating layer, the scraping speed of the coating layer is suppressed because of the presence of the inorganic particulate B so that the present inventors have concluded that color contamination to toner can be suppressed within an allowable range.

Carrier

Therefore, the carrier according to the present disclosure includes a core material particle including a magnetic material and a coating layer disposed on the surface of the core material particle, the coating layer including a resin, carbon black, an inorganic particulate A, and an inorganic particulate B.

The carbon black has a concentration gradient along a thickness direction of the coating layer with a concentration from high to low toward the surface of the coating layer.

The inorganic particulate A has a concentration gradient along a thickness direction of the coating layer with a concentration from low to high toward the surface of the coating layer.

The volume ratio of the carbon black is 0-30 percent at a depth range of 0.0-0.1 μm from the surface of the coating layer.

The inorganic particulate A is electroconductive having a powder specific resistance of 200 Ω·cm or less.

For this reason, it is possible to suppress contamination to toner by thick black of carbon black even if the coating layer is scraped off little by little for an extended period of use because the coating layer is not easily scraped off due to the presence of the inorganic particulate B while utilizing the excellent resistance adjusting feature of carbon black.

In the present disclosure, there is no particular limitation to the method of providing a gradient to concentration of carbon black and the inorganic particulate A in the coating layer. For example, the following methods are suitable: (i) a method of coating a carrier core material with a resin solution including carbon black, the inorganic particulate A, and the inorganic particulate B many times while the concentration of carbon black decreases and the concentration of the inorganic particulate A increases towards the later process and (ii) a method of sequentially increasing the spraying speed of a resin solution including the inorganic particulate A while sequentially decreasing the spraying speed of a resin solution including carbon black by multiple spray coating nozzles including nozzles to spray the resin solution including carbon black and nozzles to spray the resin solution including the inorganic particulate A.

Known methods can be employed to confirm the whereabouts of carbon black and the inorganic particulate A and the volume ratio at positions near the surface. For example, the coating layer of the surface of carrier is severed by a focused ion beam (FIB) and the cross section thereof is observed by a scanning electron microscope (SEM) or energy dispersive X-ray analysis (EDX) to confirm those factors. The following is just an example and the method is not limited thereto.

A sample is caused to adhere to a carbon tape. Osmium is used for coating in an amount of about 20 nm for surface protection and electroconductive treatment. Using Carl Zeiss (NVision 40, manufactured by Seiko Instruments Inc.), the sample is subject to FIB treatment under the conditions of an acceleration voltage: 2.0 kV, an aperture: 30 μm, High Current: on, detector: SE2, InLens, no electroconductive treatment, W.D: 5.0 mm, and sample declination: 54 degrees. Using an electron cooling type SDD detector (UltraDry, Φ30 $mm^2$, manufactured by Thermo Fisher Scientific) and analysis software (NORAN System 6 (NSS), manufactured by Thermo Fisher Scientific), the sample is observed by an SEM under the conditions of an acceleration voltage: 3.0 kV, an aperture: 120 μm, High Current: On, electroconductive treatment: Os, drift calibration: Yes, W.D: 10.0 mm, measuring method: Area Scan, cumulated time: 10 sec, number of cumulation: 100 times, and sample declination: 54 degrees. By element mapping, whereabouts of carbon black and inorganic particulate A and the occupying area at a position close to the surface thereof are confirmed. The ratio of the volume of carbon black at a position close to the surface of a carrier coating layer is obtained by calculating the ratio of the cross section of carbon black to the power of two thirds to the cross section in the range of 0.0-0.1 μm from the surface to the power of two thirds.

The average thickness T of the coating layer is, for example, 0.1-3.0 μm and preferably 0.1-1.5 μm. When the coating layer is thinner than 0.1 μm, the total thickness of the coating layer is too thin to cover a carrier core material so that the carrier core material is soon to be exposed as a result of scraping-off of the coating layer over running, thereby degrading durability of the carrier. When the coating layer is thicker than 0.3 μm, the thickness of the layer formed on the surface of a carrier core material is so thick that magnetization of the carrier tends to be reduced, causing carrier attachment.

The thickness of the coating layer can be calculated as the average of the layer thickness of 50 or more points of a carrier cross section made by, for example, a focused ion beam (FIB). The 50 or more pints are observed by a transmission electron microscope (TEM) or scanning type transmission electron microscope (STEM) to obtain respective layer thicknesses.

Inorganic Particulate A

The inorganic particulate A is preferably a compound in which tin oxide is doped with tungsten, indium, phosphorus, or an oxide thereof or tungsten, indium, phosphorus, or the oxide thereof is doped with tin oxide. Also, it may be an inorganic particulate having the compound disposed on the surface of the substrate of the inorganic particulate. For this reason, even if the inorganic particulate A is detached from carrier after the coating layer is scraped off little by little over an extended period of use, contamination to toner can be suppressed because coloring of the inorganic particulate A is less.

As described above, the inorganic particulate A plays a role of securing the resistance adjustment to compensate the decrease of carbon black due to the concentration gradient. Therefore, the inorganic particulate A preferably has a high level of electroconductive ability. The present inventors have made an investigation of the powder specific resistance required for the inorganic particulate A. As a consequence, the present inventors have concluded that the powder specific resistance of the inorganic particulate A is 200 Ω·cm or less and preferably 100 Ω·cm or less. When the powder specific resistance of the inorganic particulate A is higher than 200 Ω·cm, a massive amount of the inorganic particulate A is required to demonstrate the resistance adjustment. In such a case, the inorganic particulate A tends to spill over from the surface of the coating layer. If the inorganic particulate A capable of demonstrating resistance adjustment spills over from the surface of the coating layer, the carrier resistance increases accordingly. That is, the carrier resistance changes at an early stage over time, resulting in degradation of stability of the image quality.

The volume average particle diameter of the inorganic particulate A is, for example, 50-1,200 nm and preferably 70-1000 nm.

The volume average particle diameter of the inorganic particulate A is measured by an automatic particle-size distribution analyzer (CAPA-400, manufactured by HORIBA, Ltd.). Pre-treatment of the measuring, 30 mL of aminosilane (SH6020, manufactured by Dow Corning Toray Co., Ltd.) and 300 mL of toluene solution are charged in a juicer mixer. 6.0 g of a sample is added and dispersed for 3 minute at the rotation speed of the mixer set low. A suitable amount of the thus-obtained liquid dispersion is added to 500 ml of toluene solution preliminarily placed in a beaker (1,000 mL) for dilution. The diluted solution is constantly stirred by a HOMOGENIZER. This diluted solution is measured by a particle-size distribution analyzer (CAPA-700).

The powder specific resistance is measured by the following method. A steel electrode is brought into contact with the lower part of a vinyl chloride tube having an inner diameter of one inch. 5 g of a sample is placed in the vinyl chloride tube and the steel electrode is brought into contact with the upper part of the vinyl chloride tube. Teflon® plates having a thickness of 2 mm are placed below and above the electrode and a load of 10 kg/cm$^2$ is applied by a hydraulic press. An LCR meter (4261A, manufactured by Yokogawa-Hewlett-Packard) is connected under a pressure. The resistance value r (Ω) immediately after the connection is read and the total length L (cm) is measured by a caliper. The powder specific resistance R is calculated by the following relation where the total length is 1 in the case where the vinyl chloride tube is filled with no sample.

$$R(\Omega\cdot\text{cm})=(2.54/2)2\pi r/(L-1)$$

When the powder specific resistance of the inorganic particulate A is not greater than 200 Ω·cm, it is possible to use conventional materials and new materials. Due to the prescription of the inorganic particulate B, scraping-off of the surface of the coating layer including the inorganic particulate A is suppressed. However, the coating layer is surely scraped over an extended period of use. To minimize color contamination to toner by the inorganic particulate A detached from the coating layer or contained in a detached coating layer, the inorganic particulate A is preferably as close as possible to white or transparent. As the material having good color and electroconductive power, a compound in which tin oxide is doped with tungsten, indium, phosphorus, or an oxide thereof or tungsten, indium, phosphorus, or the oxide thereof is doped with tin oxide is suitable. In addition to the compound itself, particulates having the compound disposed on the surface of the base particle are also suitable. As the base particle, conventional or new materials can be used. For example, aluminum oxide and titanium oxide are preferable.

Inorganic Particulate B

Durability of the coating layer to scraping-off is enhanced by prescribing the inorganic particulate B to the coating layer. There is no particular limitation to the material of the inorganic particulate B. For example, in the case of a negatively-charged tone is used, charging power for an extended period of time is stabilized when the inorganic particulate B is made of a material having a positive polarity. Suitable examples are barium sulfate, zinc oxide, magnesium oxide, magnesium hydroxide, and hydrotalcite.

It is preferable that the diameter D of the inorganic particulate B should satisfy the following relation when the average thickness of the coating layer is defined as T.

$$D/2\leq T\leq D.$$

Therefore, the probability of the inorganic particulate B protruding from the surface of the coating layer is high. The inorganic particulate B serves as a spacer so that hazard to the coating layer can be reduced and the durability of carrier can be enhanced. In addition, more than half portion of a grain of the inorganic particulate B is embedded in the resin portion, which makes it difficult for the inorganic particulate B to be detached.

Figure 4:
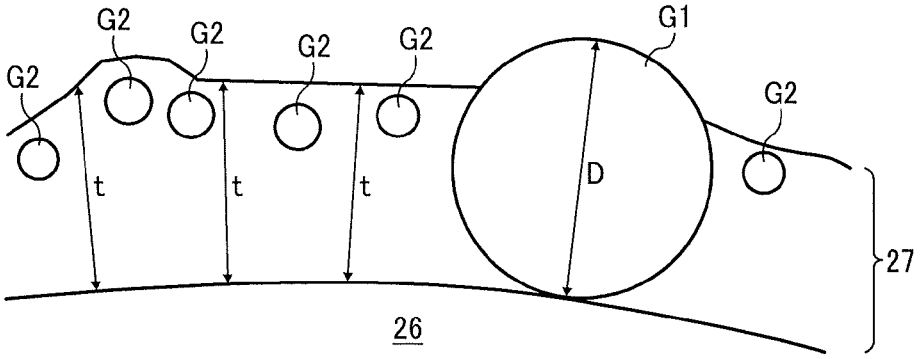
FIG. 4 is a conceptual schematic diagram illustrating the relation between the particle diameter of the electroconductive particulate in the coating layer of the carrier for electrophotography and the average thickness of the coating layer according to an embodiment of the present invention.

FIG. 4 is a conceptual schematic diagram illustrating the relation between the particle diameter D of the inorganic particulate B in the coating layer of the carrier for electrophotography of the present disclosure and the average thickness T of the coating layer.

In FIG. 4, t represents the thickness of the coating layer, D represents the diameter of the inorganic particulate B, G1 represents the inorganic particulate B, G2 represents the inorganic particulate A, 26 is the core material, 27 represents the coating layer, and T is obtained by averaging t.

Using a transmission electron microscope (TEM), the cross section of the carrier is observed and the thickness of the resin portion of the coating layer to cover the surface of the carrier is measured. The thickness t of the coating layer of the carrier is obtained as the average of the measuring results. Specifically, only the thickness of the resin portion present between the surface of the carrier core material and the particle is measured. The thickness of the resin portion present between particles and the thickness of the resin portion on the inorganic particulate are not included.

More specifically, arbitrarily-chosen 50 points on the cross section of the carrier are measured. The average is determined as the average thickness T (μm) of the coating layer. The particle diameter D of the inorganic particulate A can be measured by an automatic particle-size distribution analyzer using photo-sedimentation with gravitational and centrifugal acceleration (CAPA-700) according to the particle size measuring method of the inorganic particulate described above.

To increase the probability of the inorganic particulate B protruding from the surface of the coating layer, the particle diameter D of the inorganic particulate B is set to be greater than the average thickness T of the coating layer. If the top of the inorganic particulate protrudes from the coating layer, it serves as a spacer between a sliding target and the resin of the coating layer when carrier particles or carrier particles and the wall of an accommodating unit and a conveying jig, which prolongs the working life of the coating layer. In addition, as described above, when the inorganic particulate B has a positively-charging power and is used in a developing agent using a negatively-charged toner, the contact probability of the inorganic particulate B with the toner increases, which is preferable in terms of charging power. In addition, when the average thickness T of the coating layer is greater than a half of the particle diameter D of the inorganic particulate B, the inorganic particulate B is little or never detached because the inorganic particulate B is firmly trapped at the resin portion.

The particle of the inorganic particulate B can be measured by using, for example, Nanotrac UPA series (manufactured by NIKKISO CO., LTD.) before prescription. After prescription, it can be measured according to the method of confirming the whereabouts of carbon black and the inorganic particulate A or using an image observed with a SEM by a simpler device. In addition, the thickness of the coating layer can be similarly measured by an image observed by the SEM. However, due to the variation of the thickness depending on the locality of the coating layer and the individual difference of the inorganic particulate A, the numbers of particles and sites to be measured are determined taking into statistics.

The volume average particle diameter of the inorganic particulate B is, for example, 100-6,000 nm and preferably 200-3,000 nm. The particle diameter D of the inorganic particulate B can be measured by an automatic particle-size distribution analyzer using photo-sedimentation with gravitational and centrifugal acceleration (CAPA-700) according to the particle size measuring method of the inorganic particulate described above.

Coating Resin

As the coating resin of carrier, silicone resins, acrylic resins, or a combination thereof can be used. Acrylic resins have strong adherence and low brittleness. Therefore, it has excellent abrasion resistance. On the other side of the coin, the surface energy is high so that, in a combination with toner that tends to be easily spent, toner component spent accumulates, which causes problems such as reduction of charging size. In such a case, a combinational use of a silicone resin solves the problem because the silicone resin is such that the toner component is little or never spent because the surface energy is low and accumulation of spent component to cause film scraping does not easily proceed. However, silicone resins have weak adherence and high brittleness. Therefore, it is easily abraded. Accordingly, striking a balance between those properties of both resins is required to obtain a coating layer that is not easily spent but has good abrasion resistance. In such a case, due to the silicone resin having low surface energy so that the toner component is not easily spent, accumulation of spent component to cause film scraping does not easily proceed.

The silicone resin in the present disclosure represents all of the known silicone resins. Examples include, but are not limited to, straight silicone resins formed of only organosiloxane bonding and silicone resins modified by alkyd resins, polyester resins, epoxy resins, acrylic resins, urethane resins, etc. Products of straight silicone resins available on the market can be used. Specific examples include, but are not limited to, KR271, KR255, and KR152, manufactured by Shin-Etsu Chemical Co., Ltd. and SR2400, SR2406, and SR2410, manufactured by DOW CORNING TORAY CO., LTD. It is possible to use a simple silicone resin and also possible to use it with a component that conducts cross-linking reaction, a charge-control component, etc. simultaneously. Products of modified silicone resins available on the market can be also used. Specific examples include, but are not limited to, KR206 (alkyd-modified), KR5208 (acrylic-modified), ES1001N (epoxy-modified), and KR305 (urethane-modified), all manufactured by Shin-Etsu Chemical Co., Ltd. and SR2115 (epoxy-modified) and SR2110 (alkyd-modified), both manufactured by DOW CORNING TORAY CO., LTD.

As condensation polycondensation catalysts, titainum-based catalysts, tin-based catalysts, zirconium-based catalysts, and aluminum-based catalysts are suitable. In the present disclosure, of these various catalysts, of the titanium-based catalysts bringing excellent results, titanium diisopropoxybis(ethylacetateacetate) is most preferable. Titanium diisopropoxybis(ethylacetateacetate) is inferred to accelerate the condensation reaction of a silanol group and the catalyst is not easily deactivated.

The acrylic resin in the present disclosure represents all the resins including acrylic components and has no particular limitation. In addition, it is possible to use only acrylic resins but optional to use one or more other components that conduct cross-linking reaction simultaneously. Examples of the other components to conduct cross-linking reaction are amino resins and acidic catalysts. However, the other components are not limited thereto. The amino resin represents, for example, guanamie resins and melamine resins. However, the amino resins are not limited thereto. In addition, as the acidic catalyst, any article having catalystic function can be used. For example, articles having reaction groups of complete alkylized type, methylol group type, imino group type, methylol/imino group type are suitable. However, the acidic catalyst is not limited thereto.

In addition, the coating layer more preferably includes cross-linked matter of an acrylic resin and an amino resin. Such matter can prevent fusion of coating layers while keeping suitable resilience. The amino resin has no particular limit. Specifically, melamine resins and benzoguanamine resins are preferable in order to improve charging power of carrier. In addition, to suitably control the charging power of carrier, melamine resin and/or benzoguanamine resin can be used in combination with other amino resins.

As the acrylic resin cross-linkable with an amino resin, acrylic resins having hydroxyl group and/or carboxyl group are preferable and acrylic resins having a hydroxyl group are more preferable. Inclusion of such resins improves adherence of core particles and electroconductive particulates more and enhance dispersion stability of the electrocondcutive particulates. The acrylic resin preferably has a hydroxyl value of 10 mgKOH/g or greater and more preferably 20 mgKOH/g or greater.

In the present disclosure, the composition for coating layer preferably includes a silane coupling agent. Such inclusion makes it possible to stably disperse the electroconductive particulate.

There is no specific limitation to the silane coupling agent. Specific examples include, but are not limited to, γ-(2-aminoethyl)aminopropyl trimethoxyslane, γ-(2-aminoethyl) aminopropyl methyldimethoxydlane, γ-methacryloxy propyltrimethoxysialne, N-β-(N-vinylbenzyl aminoethyl)-γ-aminopropyl trimethoxysialne hydrochloride, γ-glycidoxypropyl trimethoxysilane, γ-meracaptopropyl trimethoxyslane, methyltrimethoxysilane, methyltriethoxysilane, vinyltriacetoxysialne, γ-chloropropyl trimethoxyxilane, hexamethyldislazane, γ-anilinopropyl trimethoxyxilane, vinyltrimethoxyxilane, octadecyldimethyl[3-(trimethoxysilyl)propyl]ammonium chloride, γ-chloropropylmethyl dimethoxy silane, methyltrichlorosilane, dimethyl dichlorosilane, trimethylchlorosilane, aryltriethoxysialne, 3-aminopropylmethyl diethoxysilane, 3-aminopropyltrimethoxysilane, dimethyl diethoxysilane, 1,3-divinyltetramethyl disilazane, and methacryloxy ethyl dimethyl(3-trimethoxysilylpropyl)ammonium chloride. These can be used alone or in combination.

Specific examples of the silane coupling agent available on the market include, but are not limited to, AY43-059, SR6020, SZ-6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all manufactured by Dow Corning Toray Co., Ltd.).

The content rate of the silane coupling agent to a silicone resin is preferably 0.1 to 10 percent by mass. When the content of the silane coupling agent is less than 0.1 percent by mass, the adherence of core material particles and electroconductive particulates and a silicone resin deteriorates so that the coating layer may be detached over an extended period of use. When the content of the silane coupling agent is greater than 10 percent by mass, filming of toner tends to occur over an extended period of use.

Core Material

There is no specific limitation to the core material particle for use in the carrier of the present disclosure. In the case of the magnetic substance, two-component carrier for electrophotography can be suitably selected to suit to a particular application among known substances. Specific examples are strong magnetic metal such as iron or cobalt, iron oxide such as magnetite, hematite, and ferrite, various alloyed metals or compounds, and resin particles in which such magnetic substances are dispersed in a resin. Of these, in terms of concerns about environment, Mn-based ferrite, Mn—Mg-based ferrite, and Mn—Mg—Sr ferrite are preferable. Specifically, MFL-35S, MFL-35HS (both manufactured by Powdertech CO., Ltd.), DFC-400M, DFC-410M, and SM-350NV (all manufactured by DOWA Electronics Materials Co., Ltd.) are suitable.

There is no specific limitation to the volume average particle diameter of the core material of the carrier for use in the present disclosure. In terms of prevention of carrier attachment and carrier scattering, the volume average particle diameter is preferably 20 μm or greater. In terms of prevention of defective images with carrier streaks, etc. to prevent degradation of the image quality, the volume average particle diameter is preferably no greater than 100 μm. In particular, using a core material having a volume average particle diameter of 20-60 μm matches the demand for higher image quality of late. The volume average particle diameter can be measured by a microtrack particle size analyzer (model HRA 9320-X100, manufactured by NIKKISO CO., LTD.).

It is preferable that the carrier material have a shape factor SF2 of 120-160 and an arithmetical mean roughness Ra of 0.5-1.0 μm. In this range, carrier can have excellent charging stability and resistance stability over time in particular. The mechanism of this is not clear but when the shape factor of core material and arithmetical mean roughness are within the range specified above, the carrier has a suitable roughness. Therefore, toner spent on the carrier can be scraped off, which prevents decrease of charging and increase of resistance caused by spent. When SF2 of the core material particle is 120 or less, carrier cannot have the roughness the present disclosure intends to have but is close to a sphere, which inhibits scraping-off of spent matter.

When SF2 of the core material particle is 160 or greater and the carrier is used in a developing device for an extended period of time, exposure of the core material to the surface is excessive so that the variation between the initial resistance value and the resistance value after use is large. As a result, the amount of toner on a latent electrostatic image bearer and how the toner is carried thereon change, thereby destabilizing the image quality.

Shape factors SF1 and SF2 represent the following. SF1 and SF2 indicating shape factors are defined as follows: 100 carrier particle images enlarged with 300× power using, for example, a Field-Emission Scanning Electron Microscope (FE-SEM) (S-800, manufactured by Hitachi Ltd.) are subject to sampling at random and the image information is introduced into, for example, an image analyzer (Luzex AP, manufactured by NIRECO CORPORATION) for analysis via an interface. The values obtained by the following relations 1 and 2 are defined as shape factors SF1 and SF2.

$$SF1=(L2/A)\times(\pi/4)\times100 \quad \text{Relation 1}$$

$$SF2=(P2/A)\times(1/4\pi)\times100 \quad \text{Relation 2}$$

In the relations, L represents the absolute maximum length (length of circumcircle of a particle, P represents a circumference length of the particle, and A represents a projected area of the particle. The shape factor SF1 represents the degree of circularity and the shape factor SF2 represent the degree of roughness of a particle. SF1 increases as the shape is away from circle (sphere). When the roughness of the surface increases, SF2 increases.

In the present disclosure, the arithmetical mean roughness Ra represents the following in the present disclosure. Using OPTELICS C130 (manufactured by LASERTEC), images are take in with a magnification power of 50× of the object lens and resolition of 0.20 μm. Thereafter, the observation area is set 10 μm×10 μm with the top of the core material centered. The number of core material particles is 100.

Developing Agent

The developing agent of the present disclosure includes the carrier of the present disclosure and toner, which is a two-component developing agent.

The mixing rate of the toner to the carrier in the developing agent is preferably 1-10 percent by mass.

Toner

The toner includes a binder resin and a coloring agent with optional components such as a release agent and a charge control agent. In addition, the toner preferably includes an external additive.

The toner may be one of monochrome toner, color toner, white toner, and transparent toner. The carrier of the present disclosure is to prevent contamination of toner by carbon black. It significantly demonstrates the effect when the carrier is used as a developing agent in combination with color toner, in particular, yellow toner, white toner, or transparent toner.

The toner particle preferably includes a release agent when it is applied to an oil free system in which no oil preventive for toner fixation is applied to a fixing roller. Such toner tends to cause filming in general. However, since the carrier of the present disclosure can suppress occurrence of filming, the developing agent of the present disclosure can maintain good quality for an extended period of time.

Toner can be manufactured by a known method such as a pulverization method and a polymerization method. For example, when toner is manufactured by a pulverization method, melt-kneaded mixture obtained by mixing and kneading a toner material is cooled down, pulverized, and classified to manufacture mother particles. Next, to improve transferability and durability, external additives are added to the mother particle to manufacture toner.

The device to mix and knead toner materials is not particularly limited. For example, batch-type twin rolls, Bumbury's mixer, continuation-type twin shaft extruder such as a KTK type twin-shaft extruder (manufactured by KOBE STEEL, LTD.), a TEM type twin-shaft extruder (manufactured by TOSHIBA MACHINE CO., LTD.), a twin-shaft extruder (manufactured by ASADA IRON WORKS CO., LTD.), a PCM type twin-shaft extruder (manufactured by IKEGAI LTD.), and a KEX type twin-shaft extruder (manufactured by KURIMOTO LTD.); and a continuation-type single-shaft kneader such as a Co-Kneader manufactured by COPERION BUSS AG can be preferably used as a device to mix and knead a toner.

When the cooled-down melt-kneaded mixture is thereafter pulverized, it is coarsely-pulverized by, for example, a hammer mill, ROTOPLEX, etc., and thereafter finely-pulverized by a fine pulverizer using a jet air or a mechanical fine pulverizer. It is preferable to pulverize the mixture until the average particle diameter becomes 3-15 μm.

Moreover, to further classify the pulverized melt-kneaded mixture, an air classifier can be used. It is preferable to classify the mixture such that the average particle diameter of the mother particle is 5-20 μm.

In addition, when an external additive is added to the mother particle, these are mixed and stirred by a mixer so that the external additive is caused to adhere to the surface of the mother particle while the external additive is pulverized.

Binder Resin

The binder resin is not particularly limited. Specific examples include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-methyl vinyl ketone copolymers, styrene-butadiene copolymers, styrene-isoprene copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, and aromatic petroleum resins. These resins can be used alone or in combination.

The binder resin for pressure fixing is not particularly limited.

Specific examples include, but are not limited to, polyolefins such as low molecular weight polyethylenes and low molecular weight polypropylenes; olefin copolymers such as ethylene acrylic acid copolymers, styrene-methacrylic acid copolymers, ethylene methacryrate copolymers, ethylene-vinyl chloride copolymers, ethylene-vinyl acetate copolymers, and ionomer resins; epoxy resins, polyester resins, styrene-butadiene copolymers, polyvinyl pyrrolidone, methylvinyl ether-maleic anhydride, maleic acid modified phenol resins, and phenol modified terpene resins. These can be used alone or in combination.

Coloring Agent

The coloring agent (pigment or dye) is not particularly limited. Specific examples include, but are not limited to, yellow pigments such as cadmium yellow, mineral fast Yellow, nickel titanium yellow, naples yellow, Naphthol Yellow S, Hanza Yellow G, Hanza Yellow 10G, Benzidine Yellow GR, quinoline yellow lake, Permanent Yellow NCG, and tartrazine lake, orange pigments such as molybdenum orange, Permanent Orange GTR, pyrazolone orange, Vulcan Orange, and Indanthrene Brilliant orange GK, red pigments such as red iron oxide, cadmium red, Permanent Red 4R, lithol red, pyrazolone red, watching red calcium salt, Lake Red D, Brilliant Carmine 6B, Eosin Lake, Rhodamine Lake B, Alizarin Lake, and Brilliant Carmine 3B, violet pigments such as Fast Violet B and Methyl Violet Lake, blue pigments such as cobalt blue, Alkali Blue, Victoria Blue Lake, Phthalocyanine Blue, metal-free Phthalocyanine Blue, Phthalocyanine Blue partly chlorinated article, Fast Sky Blue, and Indanthrene Blue BC, green pigments such as Chrome Green, chromium oxide, Pigment Green B, and Malachite Green Lake, black pigments such as adine-based pigments such as carbon black, oil furnace black, channel black, lamp black, acetylene black, and aniline black, meal salt azo pigments, metal oxides, and complex metal oxides, and white pigments such as titanium oxide. These can be used alone or in combination. Also, these not be used in the case of transparent toner.

Release Agent

The release agent is not particularly limited.

Specific examples include, but are not limited to, polyolefins such as polyethylene and polypropylene, metal salts of aliphatic acid, esters of aliphatic acid, paraffin wax, amide-based waxes, polyalcohol waxes, silicone waxes, carnauba wax, ester waxes. These can be used alone or in combination.

There is no specific limitation to the content of the release agent in the toner. For example, the content is preferably 1-40 percent by mass and more preferably 3-30 percent by mass. When the content of the release agent is greater than 40 percent by mass, the flowability of the toner may deteriorate.

Charge Control Agent

The toner may furthermore include a charge control agent. The charge control agent is not particularly limited. Specific examples include, but are not limited to, nigrosine, azine-based dyes having an alkyl group having 2 to 16 carbon atoms (refer to Examined Japanese Patent Application No. S42-1627), basic dyes such as C.I. Basic Yellow 2 (C.I.41000), C.I. Basic Yellow 3, C.I. Basic Red 1 (C.I.45160), C.I. Basic Red 9 (C.I.42500), C.I. Basic Violet 1 (C.I.42535), C.I. Basic Violet 3 (C.I.42555), C.I. Basic Violet 10 (C.I.45170), C.I. Basic Violet 14 (C.I.42510), C.I. Basic Blue 1 (C.I.42025), C.I. Basic Blue 3 (C.I.51005), C.I. Basic Blue 5 (C.I.42140), C.I. Basic Blue 7 (C.I.42595), C.I. Basic Blue 9 (C.I.52015), C.I. Basic Blue 24 (C.I.52030), C.I. Basic Blue 25 (C.I.52025), C.I. Basic Blue 26 (C.I.44045), C.I. Basic Green 1 (C.I.42040), and C.I. Basic Green 4 (C.I.42000), Lake pigments of these basic dyes, C.I. Solvent Black 8 (C.I. 26150), quaternary ammonium salts such as benzoyl methyl hexadecyl ammonium chloride and decyl trimethylchloride, dialkyl tin compounds such as dibutyl tin compounds and dioctyl tin compounds, dialkyl tin borates, guanidine derivatives, vinyl-based polymers having an amino group, polyamine resins such as condensed polymers having an amino group, metal complex salts of monoazo dyes specified in Examined Japanese Patent Application Nos. S41-20153, S43-27596, S44-6397, and S45-26478, salycylic acids specified in Examined Japanese Patent Application Nos. 55-42752 and S59-7385, metal (e.g., Zn, Al, Co, Cr, and Fe) complexes of diallkyl salycylic acid, naphthoic acid, and dicarbosylic acid, sulfonated copper phthalocyanine pigments, organic boron salts, fluorine-containing quaternary ammonium salts, and calixarene. These can be used alone or in combination. Metal salts of white salicylic derivatives are preferable for color toner excluding black toner.

The content of the charge control agent is determined depending on the kind of a binder resin and the toner manufacturing method including a dispersion method and therefore is not unambiguously defined. However, the content is preferably 0.1-10 percent by mass and more preferably 0.2-5 percent by mass based on the binder resin. When the content is greater than 10 percent by mass, the toner tends to have an excessively large charging size, which reduces the effect of the charge control agent. Therefore, the electrostatic attraction force between the developing roller and the toner increases, resulting in deterioration of the flowablity of the developing agent and image density. When the content is less than 0.1 percent by mass, initial rising of charging and the charging size tend to be insufficient, which may have an adverse impact on toner images.

External Additive

The external additive is not particularly limited. Examples are inorganic particles of silica, titanium oxide, alumina, silicone carbide, silicon nitride, boron nitride, etc. and resin particles such as polymethacrylic acid methyl particles and polystyrene particles having a volume average particle diameter of 0.05-1 μm obtained by a soap-free emulsification polymerization method. These can be used alone or in combination. Of these, metal oxide particles of silica, titanium oxide, etc. having a hydrophobized surface are preferable. Furthermore, by a combinational use of hydrophobized silica and hydrophobized titanium oxide in an amount of the titanium oxide greater than that of the silica, a toner having a chargeability stable to humidity can be obtained.

Form, etc. of Toner

There is no specific limit to the size and form of toner. It is preferable that the toner have the following average circularity, volume average particle diameter, the ratio (volume average particle diameter to number average particle diameter) of the volume average particle diameter to the number average particle diameter.

The average circularity is a value obtained by dividing the circumference of a circle corresponding to the projection area of the toner shape by the circumference of the toner particle and is preferably, for example, 0.900-0.980 and more preferably 0.950-0.975. It is preferable that toner include particles having an average circularity less than 0.94 in an amount of 15% or less.

The volume average particle diameter of the toner is not particularly limited and can be suitably selected to suit to a particular application. For example, the volume average particle diameter is 3-10 μm and more preferably 3-8 μm.

When the volume average particle diameter is less than 3 μm, toner tends to be fused to the surface of the carrier during stirring in the developing device over an extended period of time, thereby degrading the charging power of the carrier in the case of a two component developing agent. When the volume average particle diameter is greater than 10 μm, it tends to be difficult to produce quality images with high definition and the particle diameter of the toner tends to vary significantly when the toner in the developing agent is replenished.

The ratio (volume average particle diameter to number average particle diameter) of the volume average particle diameter to the number average particle diameter in the toner is preferably 1.00-1.25 and more preferably 1.10-1.25.

Method of Manufacturing Toner

Toner can be manufactured by a known method such as a pulverization method and a polymerization method. For example, when toner is manufactured by a pulverization method, melt-kneaded mixture obtained by mixing and kneading a toner material is cooled down, pulverized, and classified to manufacture mother particles. Next, to improve transferability and durability, external additives are added to the mother particle to manufacture toner.

The device to mix and knead toner materials is not particularly limited. For example, batch-type twin rolls, Bumbury's mixer, continuation-type twin shaft extruder such as a KTK type twin-shaft extruder (manufactured by KOBE STEEL, LTD.), a TEM type twin-shaft extruder (manufactured by TOSHIBA MACHINE CO., LTD.), a twin-shaft extruder (manufactured by ASADA IRON WORKS CO., LTD.), a PCM type twin-shaft extruder (manufactured by IKEGAI LTD.), and a KEX type twin-shaft extruder (manufactured by KURIMOTO LTD.); and a continuation-type single-shaft kneader such as a Co-Kneader manufactured by COPERION BUSS AG can be preferably used as a device to mix and knead a toner.

In addition, when the cooled-down melt-kneaded mixture is thereafter pulverized, it is coarsely-pulverized by, for example, a hammer mill, ROTOPLEX, etc., and thereafter finely-pulverized by a fine pulverizer utilizing a jet air or a mechanical fine pulverizer. It is preferable to pulverize the mixture until the average particle diameter becomes 3-15 μm.

Moreover, to further classify the pulverized melt-kneaded mixture, an air classifier can be used. It is preferable to classify the mixture such that the average particle diameter of the mother particle is 5-20 μm.

In addition, when an external additive is added to the mother particle, these are mixed and stirred by a mixer, etc. so that the external additive is caused to adhere to the surface of the mother particle while the external additive is pulverized.

Image Forming Method and Image Forming Apparatus

The image forming method of the present disclosure includes a latent electrostatic image forming step of forming a latent electrostatic image on a latent electrostatic image bearer, a developing step of developing the latent electrostatic image with the developing agent of the present disclosure to form a visible image, a transfer step of transferring the visible image to a recording medium, and a fixing step of fixing the transferred image transferred onto the recording medium. The image forming method of the present disclosure includes optional steps such as a cleaning step, a discharging step, a recycling step, and a control step.

The image forming apparatus of the present disclosure includes a latent electrostatic image bearer to bear a latent electrostatic image, a latent electrostatic image forming device to form the latent electrostatic image, a developing device to develop the latent electrostatic image with the developing agent of the present disclosure to form a visible image, a transfer device to transfer the visible image from the image bearer onto a recording medium, and a fixing device to fix the transferred visible image on the recording medium. Furthermore, the image forming apparatus optionally includes other suitably selected devices to suit to a particular application such as a discharging device, a recycling device, a cleaner, and a control device.

The details are described below.

Latent Electrostatic Image Forming Step and Latent Electrostatic Image Forming Device The latent electrostatic image forming process is a process of forming a latent electrostatic image on a latent electrostatic image bearer.

There is no specific limitation to the latent electrostatic image bearer (also referred to as electrophotographic photoconductor, photocondcutor, or photoreceptor) with regard to material, form, structure, size, etc. and any known latent electrostatic image bearer can be suitably selected. A latent electrostatic image bearer having a drum-like form is preferable. Also, for example, an inorganic photoconductor made of amorphous silicone or selenium and an organic photoconductor (OPC) made of polysilane or phthalopolymethine are suitable. Of these, in terms of producing finer images, the organic photoconductor is preferable.

Latent electrostatic images are formed by, for example, uniformly charging the surface of the latent electrostatic image bearer and irradiating the surface according to the obtained image information using the latent electrostatic image forming device.

The latent electrostatic image forming device includes, for example, at least a charger serving as a charging device to uniformly charge the surface of the latent electrostatic image bearer and an irradiator serving as an irradiating device to irradiate the surface of the latent electrostatic image bearer with light according to the obtained image information.

The charging is conducted by, for example, applying a bias to the surface of the image bearer with the charger.

There is no specific limitation to the charging device and the charging device can be selected to suit to a particular application. Known contact type chargers having an electroconductive or semi-electroconductive roll, brush, film, rubber blade, etc. and non-contact type chargers such as a corotron or a scorotron which utilizes corona discharging can be used.

It is preferable to apply a direct voltage on which an alternate voltage is superimposed to the surface of the latent electrostatic image bearer by the charger disposed in contact with or in the vicinity of the latent electrostatic image bearer.

The charger is preferably a charging roller disposed in contact with the latent electrostatic image bearer with a gap tape therebetween. It is preferable that the charging roller apply a direct voltage on which an alternate voltage is superimposed to charge the surface of the latent electrostatic image bearer.

The irradiation is conducted by, for example, irradiating the surface of the latent electrostatic image bearer with the irradiator.

There is no specific limit to the selection of the irradiator as long as the irradiator irradiates the surface of the latent electrostatic image bearer charged by the charger according to data information. The irradiator can be suitably selected to suit to a particular application. Specific examples include, but are not limited to, various kinds of irradiatiors such as photocopying optical systems, rod-lens array systems, laser optical systems, and liquid crystal shutter optical systems.

As to the present disclosure, the rear side irradiation system of irradiating a latent electrostatic image bearer from the rear side can be also employed.

Developing Step and Developing Device

In the development process, the latent electrostatic image is developed with the developing agent to render the latent electrostatic image visible.

The visible image is formed by, for example, developing the latent electrostatic image with the toner by using the developing device.

The developing device preferably includes, for example, a developing unit to accommodate the developing agent and provide the toner to the latent electrostatic image in a contact or non-contact manner. The developing unit preferably includes a container containing the toner.

The developing unit is either a single color developing unit or a multi-color developing unit. The developing unit suitably includes, for example, a stirrer to triboelectrically charge the toner and a rotatable magnet roller.

In the developing unit, for example, the toner and the carrier are mixed and stirred to triboelectrically charge the toner due to friction therebetween. The toner is held on the surface of the rotating magnet roller to form a magnet brush like a filament. Since the magnet roller is disposed in the vicinity of the latent electrostatic image bearer (photoconductor), some of the toner forming the magnet brush borne on the surface of the magnet roller is transferred to the surface of the latent electrostatic image bearer by the force of the electric attraction. As a result, the latent electrostatic image is developed with the toner and rendered visible by the toner on the surface of the latent electrostatic image bearer (photoconductor).

Transfer Step and Transfer Device

The transfer step mentioned above is to transfer the visible image to a recording medium. It is preferable to use an intermediate transfer body to which the visible image is primarily transferred and from which the primarily transferred visible image is secondarily transferred to the recording medium. Furthermore, it is more preferable to use a two or more color toner. In such a case, visible color toner images are transferred to the intermediate transfer body to form a complex transfer image (primary transfer step) and thereafter, the complex transfer image is transferred to a recording medium (secondary transfer step).

The transferring is conducted by, for example, charging the latent electrostatic image bearer (photoconductor) using a transfer charger of the transfer device. The transfer device preferably includes a primary transfer device to transfer the visible image to an intermediate transfer body to form a complex transfer image and a secondary transfer device to transfer the complex transfer image to a recording medium.

There is no specific limit to the selection of the intermediate transfer body. Any known transfer body such as a transfer belt can be suitably selected and used to suit to a particular application.

The transfer device (the primary transfer device and the secondary transfer device mentioned above) preferably includes a transfer unit to peeling-charge the visible image formed on the latent electrostatic image bearer to the recording medium side. One or more transfer devices can be disposed.

Specific examples of the transfer unit include, but are not limited to, a corona transfer unit utilizing corona discharging, a transfer belt, a transfer roller, a pressure transfer roller, and an adhesive transfer unit.

There is no specific limitation to the recording medium and any known recording medium (typically paper) can be suitably used.

Fixing Step and Fixing Device

In the fixing step, the visible image transferred onto the recording medium is fixed by a fixing device. Fixing can be conducted every time each color toner image is transferred or at once for a multi-color overlapped image.

Any fixing device can be suitably selected to suit to a particular application. Any known pressure and heating device is suitable. As the pressure and heating device, for example, a combination of a heating roller and a pressure roller or a combination of a heating roller, a pressure roller, and an endless belt is suitable.

For example, a suitable fixing device includes a heating body including a heat-generating element, a film in contact with the heating body, and a pressing member to press the heating body via the film to fix an un-fixed image on a recording medium while the recording medium passes between the film and the pressing member. The heating temperature by the pressure and heating device is preferably 80-200 degrees C.

In the present disclosure, for example, any known optical fixing device can be used together with or in place of the fixing device and the fixing step described above.

In the discharging step, a discharging bias is applied to the latent electrostatic image bearer by a discharging device.

The discharging device has no particular limit and any known discharging device that can apply a discharging bias to the latent electrostatic image bearer is suitably usable. For example, a discharging lamp is preferable.

In the cleaning step, toner remaining on the surface of the latent electrostatic image bearer is removed, which can be suitably conducted by a cleaner.

As the cleaner, any known cleaner that can remove the toner remaining on the surface of the latent electrostatic image bearer is suitable. For example, a magnetic brush cleaner, an electrostatic brush cleaner, a magnetic roller cleaner, a blade cleaner, a brush cleaner, and a web cleaner are preferable.

In the recycling step, the toner removed in the cleaning step mentioned above is returned to the developing device for re-use. This recycling process is suitably conducted by a recycling device. There is no specific limit to the recycling device and any known conveying device, etc., can be used.

In the controlling step mentioned above, each of the steps mentioned above is controlled and each step is suitably executed by a controller.

The controller has no particular limit as long as it can control the behavior of each device. Any control device is suitably usable and can be suitably selected to suit to a particular application. For example, devices such as a sequencer and a computer are preferable.

FIG. 1 is a diagram illustrating an example of the image forming apparatus of the present disclosure. An image forming apparatus 100A includes a drum image bearer 10, a charging roller 20, an irradiator, a developing device 40, an intermediate transfer belt 50, a cleaner 60 including a cleaning blade, and a discharging lamp 70.

The intermediate transfer belt 50 is an endless belt stretched over three rollers 51 disposed inside and moves in the direction indicated by an arrow in FIG. 1. Part of the three rollers 51 serves as a transfer bias roller to apply a transfer bias (primary transfer bias) to the intermediate transfer belt 50. Around the intermediate transfer belt 50, there is disposed a cleaner 90 including a cleaning blade. Furthermore, a transfer roller 80 capable of applying a transfer bias (secondary transfer bias) to transfer the toner image to a recording medium (transfer sheet) 95 is disposed facing the intermediate transfer belt 50.

In addition, around the intermediate transfer belt 50, a corona charger 58 to apply charges to the toner image transferred to the intermediate transfer belt 50 is disposed between the contact portion of the drum image bearer 10 and the intermediate transfer belt 50 and the contact portion between the intermediate transfer belt 50 and the transfer sheet 95 relative to the rotation direction of the intermediate transfer belt 50.

The developing device 40 includes a developing belt 41, a black developing unit 45K, a yellow developing unit 45Y, a magenta developing unit 45M, and a cyan developing unit 45C disposed around the developing belt 41. Each color developing unit 45 (45Y, 45M, 45C, and 45K) includes a developing agent accommodating member 42 (42Y, 42M, 42C, and 42K), a developing agent supplying roller 43 (43Y, 43M, 43C, and 43K), and a development roller 44 (44Y, 44M, 44C, and 44K). In addition, the developing belt 41 is an endless belt stretched over multiple belt rollers and moves in the direction indicated by an arrow in FIG. 1. Furthermore, the developing belt 41 partly contacts the drum image bearer 10.

The image forming method using the image forming apparatus 100A is described next. First, after uniformly charging the surface of the drum image bearer 10 using the charging roller 20, a latent electrostatic image is formed by irradiating the drum image bearer 10 with irradiation light L. Next, the latent electrostatic image formed on the drum image bearer 10 is developed with the toner supplied from the developing device 40 to form a toner image. Moreover, the toner image formed on the drum image bearer 10 is (primarily) transferred to the intermediate transfer belt 50 by a transfer bias applied by the roller 51 and thereafter (secondarily) transferred to the transfer sheet 95 by a transfer bias applied by the transfer roller 80. After the toner remaining on the surface is removed by the cleaner 60, the drum image bearer 10 from which the toner image has been transferred to the intermediate transfer belt 50 is discharged by the discharging lamp 70.

Figure 2:
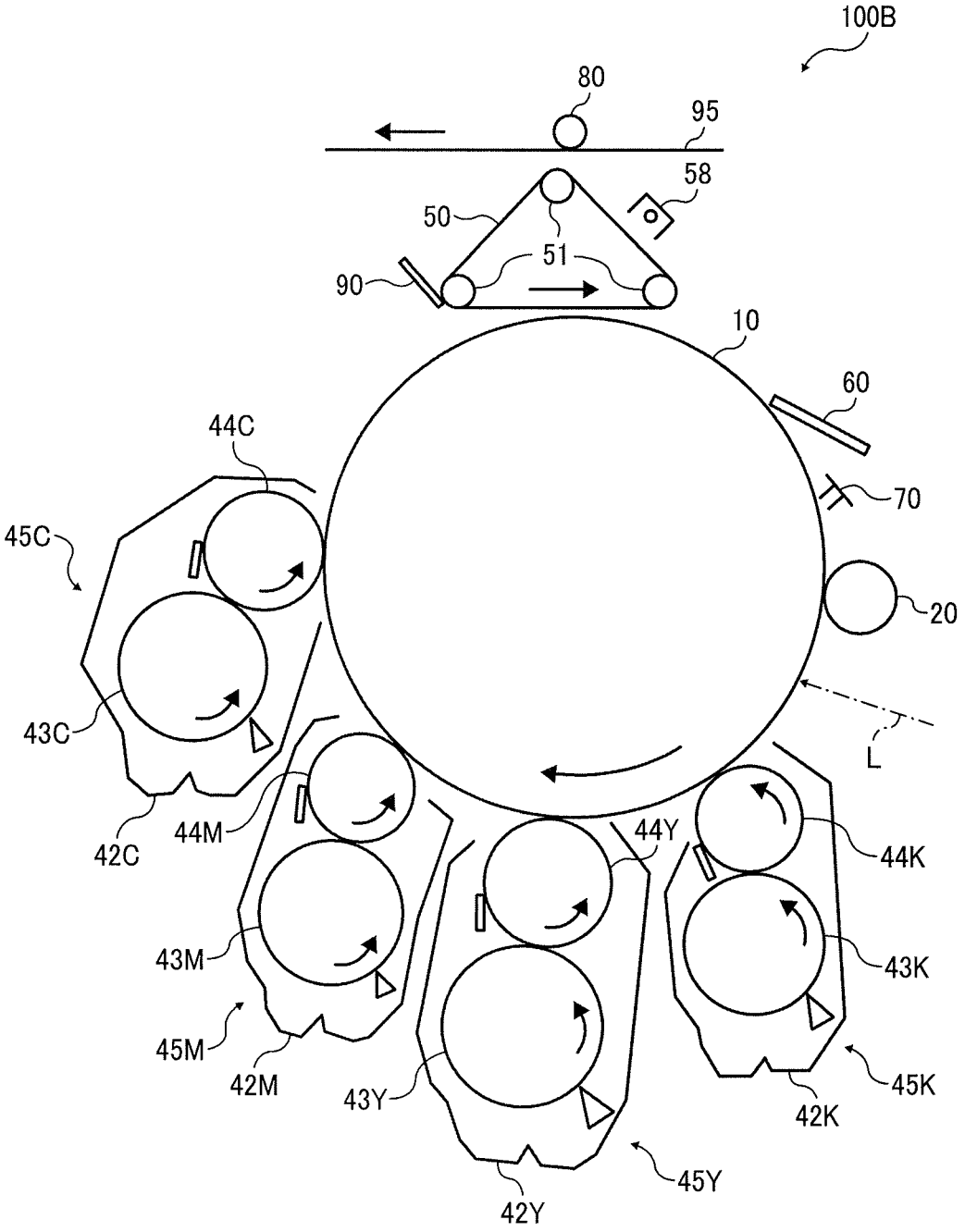
FIG. 2 is a schematic diagram illustrating another example of the image forming apparatus according to an embodiment of the present invention.

FIG. 2 is a diagram illustrating another example of the image forming apparatus for use in the present disclosure. An image forming apparatus 100B has the same configuration as the image forming apparatus 100A except that the black developing unit 45K, the yellow developing unit 45Y, the magenta developing unit 45M, and the cyan developing unit 45C are disposed around the drum image bearer 10 with no developing belt 41 provided.

Figure 3:
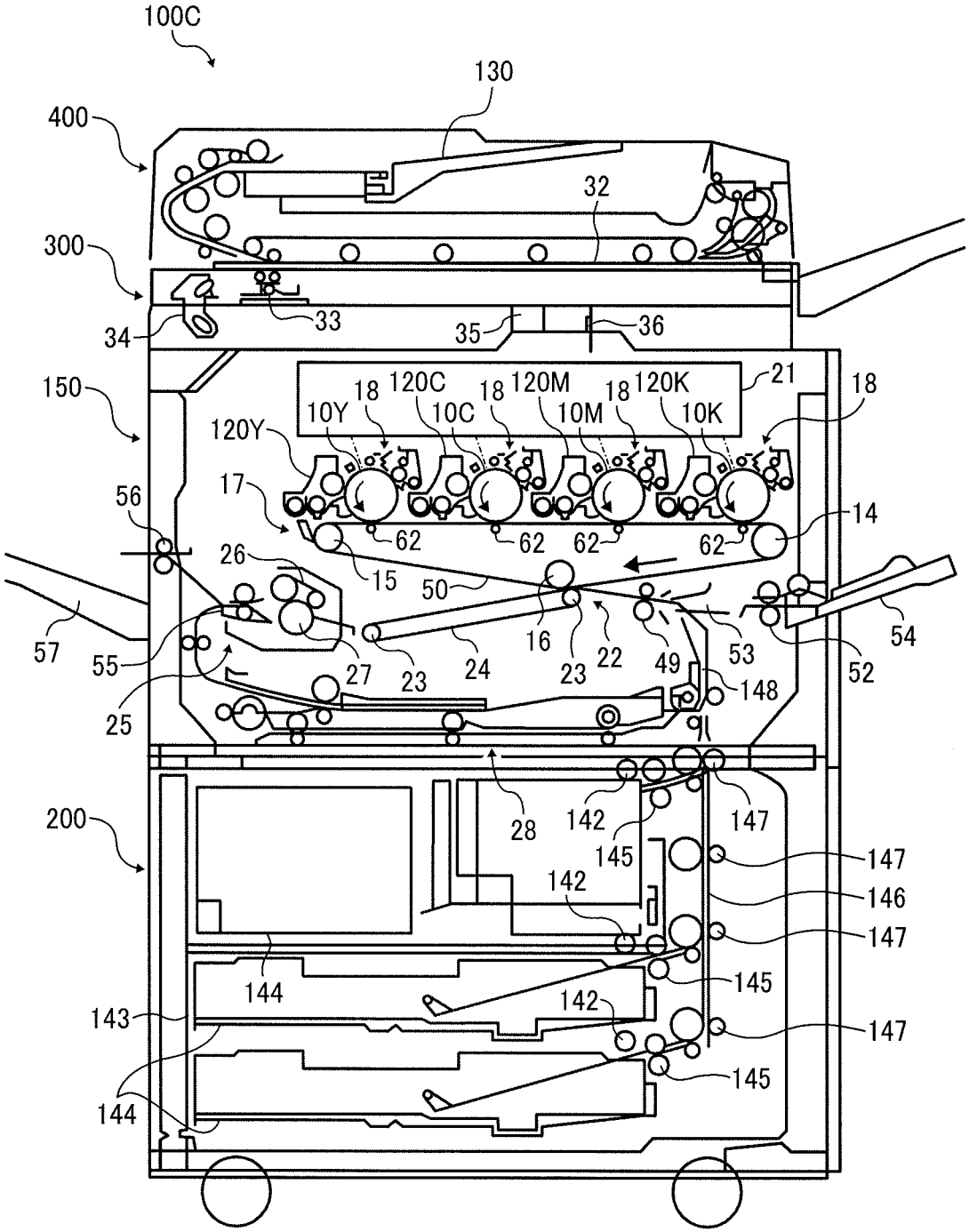
FIG. 3 is a schematic diagram illustrating an example of an image forming apparatus (tandem system, color printing) according to an embodiment of the present invention.

FIG. 3 is a diagram illustrating yet another example of the image forming apparatus for use in the present disclosure. An image forming apparatus 100C is a tandem type color image forming apparatus, including a photocopying unit 150, a sheet feeder table 200, a scanner 300, and an automatic document feeder (ADF) 400.

The intermediate transfer belt 50 disposed at the center of the photocopying unit 150 is an endless belt stretched over three rollers 14, 15, and 16 and moves in the direction indicated by an arrow in FIG. 3. Around the roller 15, a cleaner 17 is disposed including a cleaning blade to remove toner remaining on the intermediate transfer belt 50 from which the toner image has been transferred to a recording medium. Image forming units 120 (120Y, 120C, 120M, 120K) for yellow, cyan, magenta and black are disposed along the conveying direction of the intermediate transfer belt 50 while facing the intermediate transfer belt 50 stretched between the rollers 14 and 15.

In addition, an irradiator 21 is disposed near the image forming unit 120. Furthermore, a secondary transfer belt 24 is disposed on the opposite side of the image forming unit 120 relative to the intermediate transfer belt 50. The secondary transfer belt 24 is an endless belt stretched over a pair of rollers 23 and the recording medium conveyed on the secondary transfer belt 24 and the intermediate transfer belt 50 can contact each other between the rollers 16 and 23.

In addition, around the secondary transfer belt 24, there are disposed a fixing belt 26 stretched over a pair of rollers and a fixing device 25 including a pressing roller 27 pressed to the fixing belt 26. Furthermore, close to the secondary transfer belt 24 and the fixing device 25, there is provided a sheet reversing device 28 to reverse the recording medium to form images on both sides of the recording medium.

A method of forming full color images using the image forming apparatus 100C is described next. First, a color document (manual) is placed on a document table 130 of the automatic document feeder (ADF) 400. Alternatively, the automatic document feeder 400 is opened to set a color document on a contact glass 32 and then closed. When the start button is pressed, after the document moves to the contact glass 32 in the case in which the document is set on the automatic document feeder 400 or immediately in the case in which the document is set on the contact glass 32, the scanner 300 is driven to start scanning a first scanning unit 33 including a light source and a second scanning unit 34 including a mirror. Light emitted from the first scanning unit 33 is reflected at the document and the reflected light is reflected at the second carrier 34. Thereafter, the reflected light is received at a reading sensor 36 via an imaging forming lens 35 to read the document. That is, image information of black, yellow, magenta, and cyan of the document is obtained.

The image information of each color is transmitted to each color image forming unit 120 and each color toner image is formed. As illustrated in FIG. 3, each color image forming unit 120 includes the drum image bearer 10, a charging roller 18 to uniformly charge the drum image bearer 10 (10Y, 10C, 10M, and 10K), an irradiator to form each color latent electrostatic image by irradiating the drum image bearer 10 with an irradiation light L, a developing device 61 to develop each latent electrostatic image with each color developing agent to form each color toner image, a transfer roller 62 to transfer the toner image to the intermediate transfer belt 50, a cleaner 63 including a cleaning blade, and a discharging lamp 64.

Each color toner image formed by each image forming unit 120 is sequentially and primarily transferred to and superimposed on the intermediate transfer belt 50 stretched over the rollers 14, 15, and 16 to form a complex toner image.

In the sheet feeder table 200, one of the sheet feeder rollers 142 is selectively rotated to bring recording media (sheets) from one of multiple sheet cassettes 144 stacked in a sheet bank 143. A separating roller 145 separates the recording media one by one to feed it to a sheet path 146. Conveyor rollers 147 convey and guide the recording medium to a sheet path 148 in the photocopying unit 150 and the recording medium strikes at a registration roller 49 and is held there. Alternatively, the recording media on a bypass feeder 54 are brought up by rotating a sheet feeding roller and separated one by one by a separating roller 52, conveyed to a bypass sheet path 53, and struck and held at a registration roller 49.

The registration roller 49 is typically grounded but a bias can be applied thereto to remove paper dust on the recording medium. The registration roller 49 is rotated in synchronization with the complex toner image (color transfer image) on the intermediate transfer belt 50 to send the recording medium (sheet) between the intermediate transfer belt 50 and the secondary transfer device 24 and secondarily transfer the complex toner image to the recording medium. The toner remaining on the intermediate transfer belt 50 from which the complex toner image has been transferred is removed by the cleaner 17.

The recording medium to which the complex toner image is transferred is conveyed by the secondary transfer belt 24 and thereafter fixed by the fixing device 25. Next, the conveyor path is switched by a switching claw 55 to eject the recording medium to an ejection tray 57 by an ejection roller 56. Alternatively, after the switching claw 55 switches the conveyor path, the recording medium is reversed by the sheet reversing device 28 and an image is formed on the reverse side of the recording medium and thereafter the recording medium is ejected to the ejection tray 57 by the ejection roller 56.

The image forming method and the image forming apparatus of the present disclosure use the developing agent of the present disclosure as the developing agent, which makes it possible to produce quality images over an extended period of time. The configuration of the image forming apparatus for use in the present disclosure is not particularly limited. Image forming apparatuses having other configurations can be used as long as it has the same features.

In addition, in embodiments of the present disclosure, when the developing agent including the carrier and the toner mentioned above is used as a developing agent for replenishment and a developing agent for the developing device in trickle development methods, scraping-off of the surface of the carrier and toner spent on the surface of the carrier can be prevented even for an extended period of use so that degradation of the charging size of the developing agent and the electric resistance of the carrier in the developer container. As a result, the developing property is stabilized.

Another embodiment of the image forming method of the present disclosure is described next.

Figure 5:
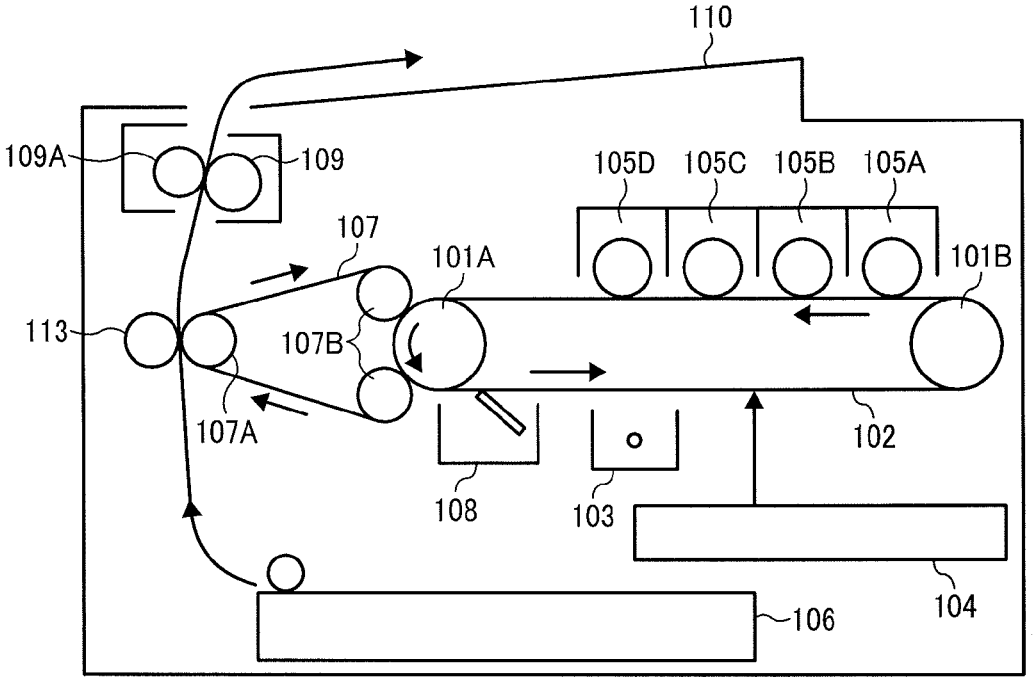
FIG. 5 is a schematic diagram illustrating another example of the image forming apparatus according to an embodiment of the present invention.

First, another embodiment of the image forming apparatus relating to the present disclosure is described. FIG. 5. is a diagram illustrating another example of the image forming apparatus of the present disclosure. In FIG. 5, the image forming apparatus includes a drive roller 101A, a driven roller 101B, a photoconductor belt 102, a charger 103, a laser writing (drawing) unit 104, each of developing units 105A, 105B, 105C, and 105D to accommodate each color toner of yellow, magenta, cyan, and black, a sheet feeding cassette 106, an intermediate transfer belt 107, a drive shaft roller 107A to drive the intermediate transfer belt 107, a driven shaft roller to support the intermediate transfer belt 107, a cleaner 108, a fixing roller 109, a pressing roller 109A, an ejection tray 110, and a sheet transfer roller 113.

In this color image forming apparatus, the intermediate transfer belt 107 is flexible for a transfer drum. The intermediate transfer belt 107 serving as the intermediate transfer body is circularly conveyed clockwise while being stretched over the drive shaft roller 107A and a pair of the driven shaft rollers 107B. The belt surface between the pair of the driven shaft rollers 107B is brought into contact with the photoconductor belt 102 at the outer circumference of the drive roller 101A.

Typically, color images are output in such a manner that a toner image of each color formed on the photoconductor belt 102 is transferred to the intermediate transfer belt 107 each time the toner image is formed to synthesize a color toner image This color toner image is transferred to a recording medium fed from the sheet feeding cassette 106 once by the sheet transfer roller 113. Thereafter, the recording medium is sent between the fixing roller 109 and the pressing roller 109A constituting the fixing device to fix the toner image on the recording medium. Subsequent to fixing, the recording medium is ejected to the ejection tray 110.

When the developing units of 105A to 105D develop the image with toner, the toner concentration in the developing agent accommodated in the developing units decreases. The decrease in the toner concentration in the developing agent is detected by a toner concentration sensor. When the decrease of the toner concentration is detected, toner replenishment devices connected with the developing units are operated to replenish the toner to increase the toner concentration. The replenished toner can be used as a developing agent for so-called trickle development method in which the replenished toner mixed with carrier can be also used if the developing unit includes a developing agent ejecting mechanism.

In FIG. 5, the toner images of respective colors are superimposed on the intermediate transfer belt to form the color toner image. Also, the image forming apparatus of the present disclosure includes a configuration in which the toner images are directly transferred to a recording medium without using an intermediate transfer belt.

Figure 6:
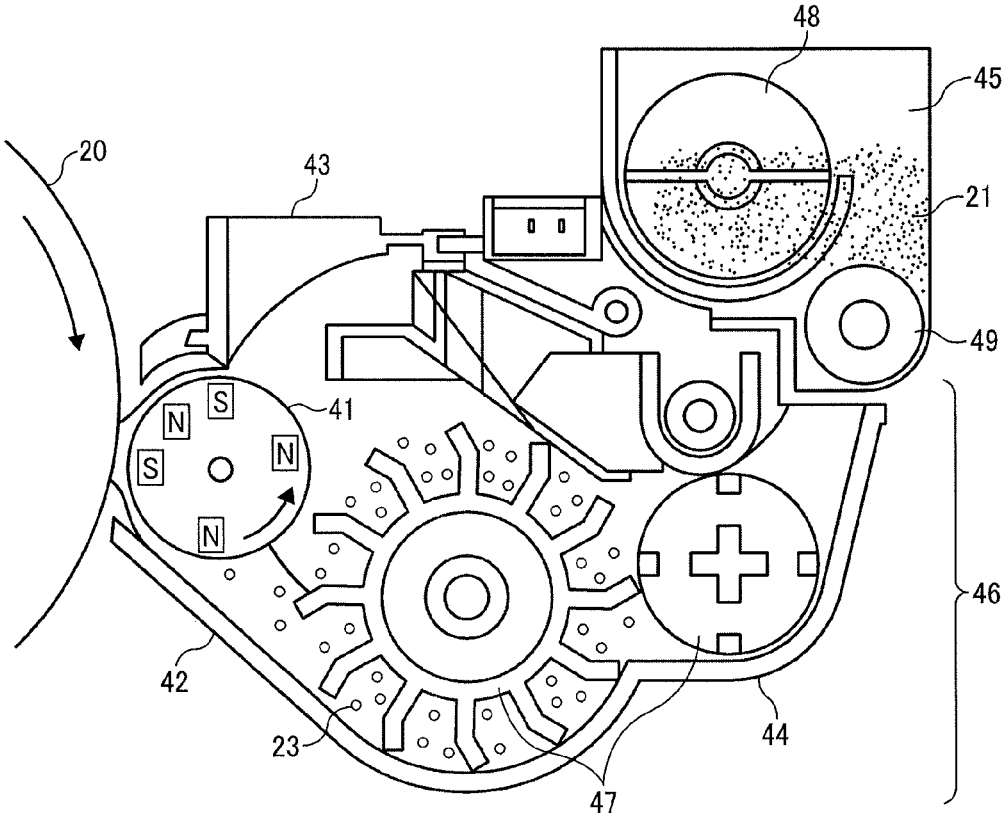
FIG. 6 is a schematic diagram illustrating an example of the developing device.

FIG. 6 is a schematic diagram illustrating an example of the developing device for use in the present disclosure and the following variations are within the scope of the present disclosure.

The developing device 40 illustrated in FIG. 6 is disposed facing the photoconductor 20 serving as a latent image bearer. The developing device 40 includes a developing sleeve 41 serving as a developing agent bearer, a developing agent accommodating member 42, a doctor blade 43 serving as a regulating member, a supporting housing 44, etc.

To the supporting housing 44 having an aperture on the side of the photoconductor 20, a toner hopper 45 serving as a toner accommodating unit to accommodate a toner 21 inside is secured. A developing agent accommodating unit 46 accommodating a developing agent including the toner 21 and a carrier 23 is disposed adjacent to the toner hopper 45. The developing agent accommodating unit 46 includes a developing agent stirring mechanism 47 to stir the toner 21 and the carrier 23 to triboelectrically charge and peeling-charge the toner 21.

Inside the toner hopper 45, there are provided a toner agitator 48 serving as a toner supplying device rotationally driven by a drive device and a toner replenishment mechanism 49. The toner agitator 48 and the toner replenishment mechanism 49 send out the toner 21 in the toner hopper 45 towards the developing agent accommodating unit 46.

The developing sleeve 41 is disposed at the space between the photoconductor 20 and the toner hopper 45. The developing sleeve 41 rotationally driven by the drive device in the direction indicated by an arrow includes a magnet inside serving as a magnetic field generating device. The magnet is disposed and fixed relatively to the developing device 40 to form a magnetic brush of the carrier 23.

The doctor blade 43 is integrally mounted with the developing agent accommodating member 42 on the other side of the supporting housing 44, facing the developing agent accommodating member 42. In this example, the doctor blade 43 is disposed with a constant gap between the front end of the doctor blade 43 and the outer periphery of the developing sleeve 41.

Such a device can be suitably modified. For example, images are formed as follows. The toner 21 sent out from the inside of the toner hopper 45 by the toner agitator 48 and the toner replenishment mechanism 49 is carried to the developing agent accommodating unit 46 and stirred in the developing agent stirring mechanism 47. As a result, the toner 21 is desirably triboelectrically/peeling-charged and conveyed together with the carrier 23 as the developing agent to the position facing the outer periphery of the photoconductor 20 while being borne on the developing sleeve 41. Thereafter, only the toner 21 is electrostatically bound with a latent electrostatic image formed on the photoconductor 20 to form a toner image on the photoconductor 20.

Figure 7:
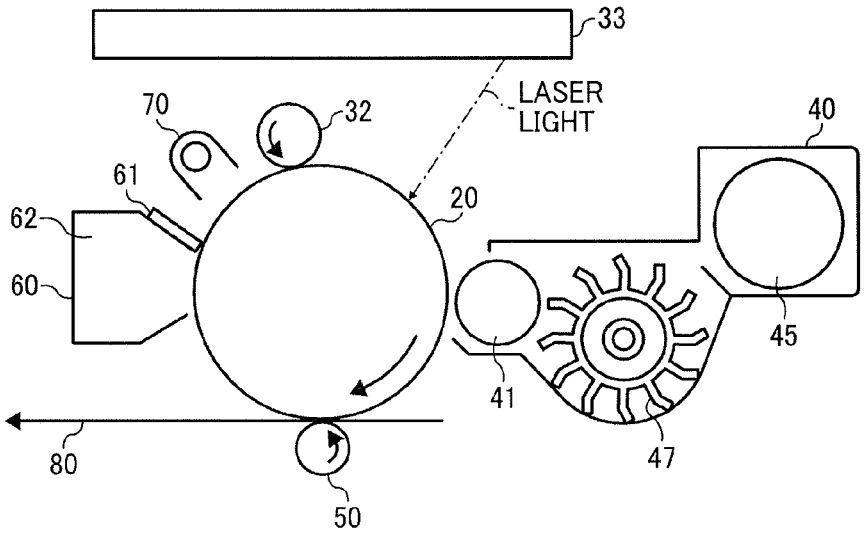
FIG. 7 is a schematic diagram illustrating yet another example of the image forming apparatus according to an embodiment of the present invention.

FIG. 7 is a diagram illustrating an example of the image forming apparatus including the developing device illustrated in FIG. 6. Around the photoconductor 20 having a drum-like form, there are provided a charging device 32, an image irradiating system 33, a developing device 40, a transfer device 50, a cleaner 60, and a discharging lamp 70. In this example, the surface of the charging device 32 is disposed with a gap of about 0.2 mm against the surface of the photoconductor 20. When the charging device 32 applies a voltage to the photoconductor 20, the photoconductor 20 is charged by an electric field in which an alternate component is superimposed on a direct current component by a voltage applying device in the charging device 32. In this configuration, a variation of charging can be reduced.

The image forming method including a developing method is executed by, for example, the following operations.

A series of the image forming processes are described using a negative-positive process. The photoconductor 20 represented by an organic photoconductor (OPC) including an organic photoconductive layer is discharged by the discharging lamp 70, uniformly and negatively charged by the charging device 32 such as a charger and a charging roller, irradiated with a laser beam emitted from the image irradiating system 33 of a laser optical system, etc. to form a latent electrostatic image (the absolute value of the irradiated site voltage is lower than the absolute value of the non-irradiated site voltage in this example).

The laser beam is emitted from, for example, a semiconductor laser and scans the surface of the photoconductor 20 in the rotation axis direction of the photoconductor 20 by, for example, the light reflected at a polygon mirror having a polygonal column rotating at a high speed. The thus-formed latent electrostatic image is developed by a mixture of toner and carrier supplied onto the developing sleeve 41 serving as a developing agent bearer included in the developing device 40 to form a toner image. When the latent image is developed, a voltage application mechanism applies a development bias of a suitable DC voltage or a bias in which an AC voltage is superimposed on the DC between the irradiated site and the non-irradiated site of the photoconductor 20.

A recording medium (typically, paper) is fed from a sheet feeding mechanism between the photoconductor 20 and the transfer device 50 in synchronization with the front end of the image at a pair of registration rollers to transfer the toner image. It is preferable that a voltage having a polarity reversed to that of the toner charging be applied to the transfer device 50 as a transfer bias. Thereafter, the recording medium 80 is separated from the photoconductor 20 to obtain a transfer image.

In addition, the toner remaining on the photoconductor 20 is retrieved into a toner retrieving chamber 62 in the cleaner 60 by the cleaning blade 61 serving as a cleaning member. It is possible to convey the retrieved toner to the developing agent accommodating unit 46 and/or the toner hopper 45 by a toner recycling device for reuse.

The image forming apparatus includes a plurality of the developing devices described above to sequentially transfer the toner images to the recording medium. Thereafter, the recording medium is conveyed to a fixing mechanism. The fixing mechanism may fix the toner with heat, etc. Alternatively, the plurality of the toner images are temporarily transferred to an intermediate transfer body and thereafter the thus-obtained toner image is transferred to the recording medium followed by fixing as described above.

Figure 8:
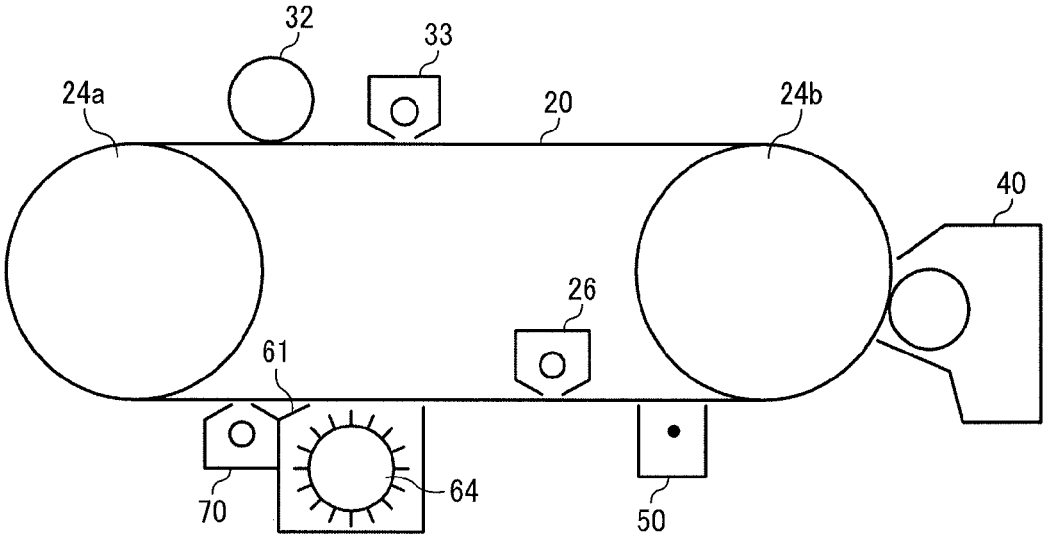
FIG. 8 is a schematic diagram illustrating still another example of the image forming apparatus according to an embodiment of the present invention.

FIG. 8 is a diagram illustrating another example of the image forming apparatus of the present disclosure. The photoconductor 20 includes at least a photosensitive layer on an electroconductive substrate. The photoconductor 20 is driven by a drive rollers 24*a* and 24*b*, charged by the charging device 32, irradiated by the image irradiating system 33, developed by the developing device 40, transferred by the transfer device 50, irradiated with a pre-cleaning irradiating light source 26, cleaned by a cleaning device 64 having a brush-like form and the cleaning blade 61, and discharged by the discharging lamp 70. In FIG. 8, the pre-cleaning irradiating light source 26 irradiates the photoconductor 20 from the substrate side. In this case, for example, the substrate is transmissive.

The image forming method in some embodiments are preferably executed in the following manner.

The image forming method includes: (i) a developing step of supplying toner to a latent image on the surface of the latent image bearer at a site where the latent image bearer faces the developing agent bearer bearing the developing agent of the present disclosure on the surface of the developing agent bearer to develop the latent image on the surface of the latent image bearer, (ii) a developing agent supplying step of conveying the developing agent along the axis direction of the developing agent bearer to supply the developing agent to the developing agent bearer, (iii) a developing agent retrieving step of conveying the developing agent retrieved from the developing agent bearer downstream of the site facing the latent image bearer along the axis direction of the developing agent bearer and in the same direction as in the developing agent supplying step, and (iv) a developing agent stirring step of supplying residual developing agent not used for the developing in the developing step but conveyed to the farthest downstream in the conveying direction in the developing agent supplying step and retrieved developing agent conveyed farthest downstream in the conveying direction in the developing agent retrieving step and conveying the residual developing agent and the retrieved developing agent along the axis direction of the developing agent bearer and in the opposite direction to the direction in the developing agent supplying step while stirring the residual developing agent and the retrieved developing agent to supply the residual developing agent and the retrieved developing agent to the developing agent supplying step.

In addition, the image forming method in some embodiments are preferably executed in the following manner.

The image forming method includes: (i) a developing step of supplying toner to a latent image on the surface of the latent image bearer at a site where the latent image bearer faces the developing agent bearer bearing the developing agent on the surface of the developing agent bearer to develop the latent image on the surface of the latent image bearer, (ii) a developing agent supplying step of conveying the developing agent along the axis direction of the developing agent bearer to supply the developing agent to the developing agent bearer by a developing agent supplying conveyor path including a developing agent supplying conveyor member to supply the developing agent to the developing agent bearer, (iii) a developing agent retrieving step of conveying the developing agent retrieved from the developing agent bearer downstream of the site facing the latent image bearer by a developing agent retrieving conveyor path including a developing agent retrieving member along the axis direction of the developing agent bearer and in the same direction as the developing agent supplying conveyor path, and (iv) a developing agent stirring step of supplying residual developing agent not used for the developing in the developing step but conveyed to the farthest downstream in the conveying direction in the developing agent supplying step and retrieved developing agent conveyed farthest downstream in the conveying direction in the developing agent retrieving step and conveying the residual developing agent and the retrieved developing agent to the developing agent supplying conveyor path by a developing agent stirring conveyor path including a developing agent stirring conveyor member along the axis direction of the developing agent bearer and in the opposite direction to the direction by the developing agent supplying conveyor path while stirring the residual developing agent and the retrieved developing agent.

Each of the developing agent supply conveyor path, the developing agent retrieving conveyor path, and the developing agent stirring conveyor path are separated by separating members except for the end portions in the longitudinal direction.

Using such a developing device including a supplying conveyor path by a supplying member (first shaft), a stirring conveyor path by a stirring conveyor member (second shaft), and a retrieving conveyor path by a retrieving conveyor member (third shaft), it is possible to produce images having less density variation on a recording medium.

The developing agent supplied to the development area by the supplying member does not return to the supplying conveyor path but to the stirring conveyor path directly or via the retrieving conveyor path and sent to the supplying conveyor path again via the stirring step. This development method is also referred to as a one way direction circulation development.

In this development method, the developing agent passing through the supplying conveyor path without being supplied to the development area and the developing agent retrieved to the stirring conveyor path or the retrieving conveyor path via the development area are mixed in the stirring conveyor path and sent to the supplying conveyor path.

Therefore, since the supplying conveyor path is free of contamination of the developing agent including a toner having a concentration reduced as a result of the usage in development, the variation of the amount of toner attachment ascribable to the variation of the toner concentration during development little or never occurs. Therefore, it is possible to produce images with stable toner concentration at any site on a recording medium.

Figure 9:
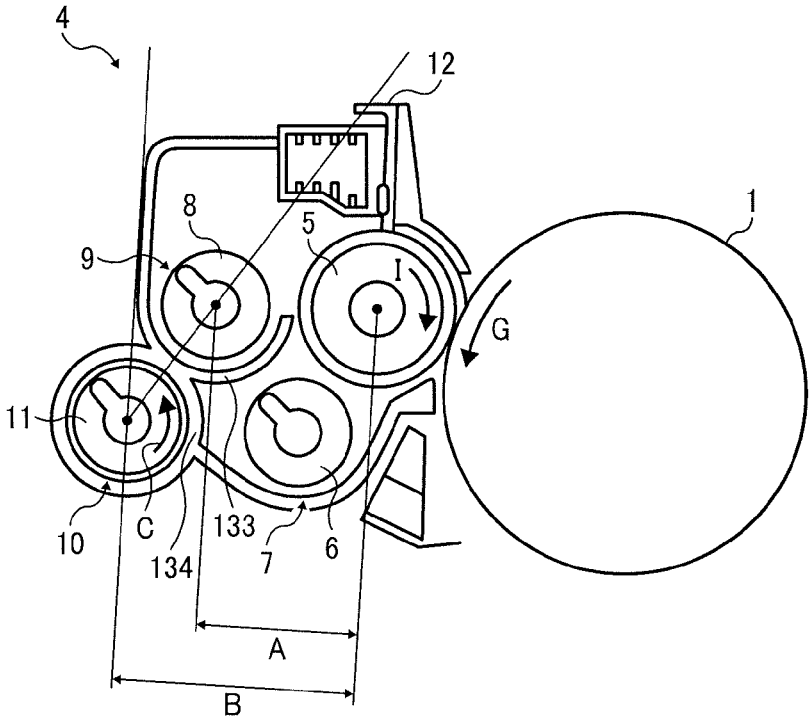
FIG. 9 is a schematic diagram illustrating another example of the developing device.
Figure 10:
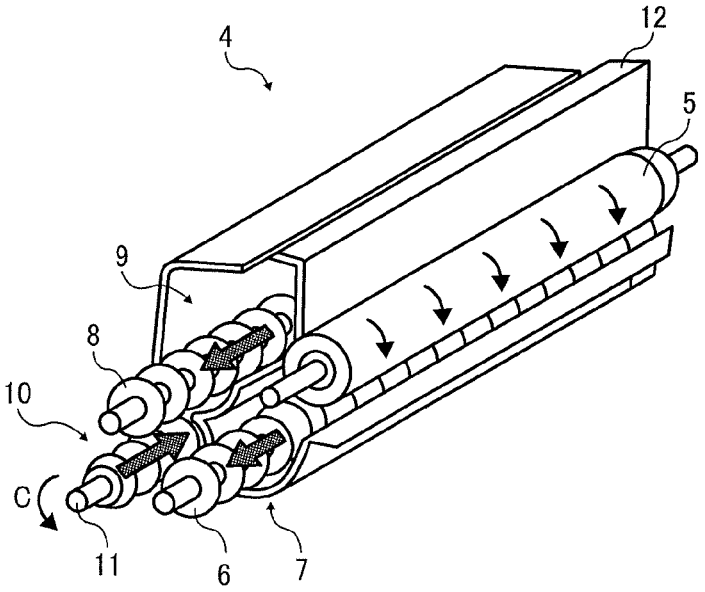
FIG. 10 is a schematic diagram illustrating yet another example of the developing device.
Figure 11:
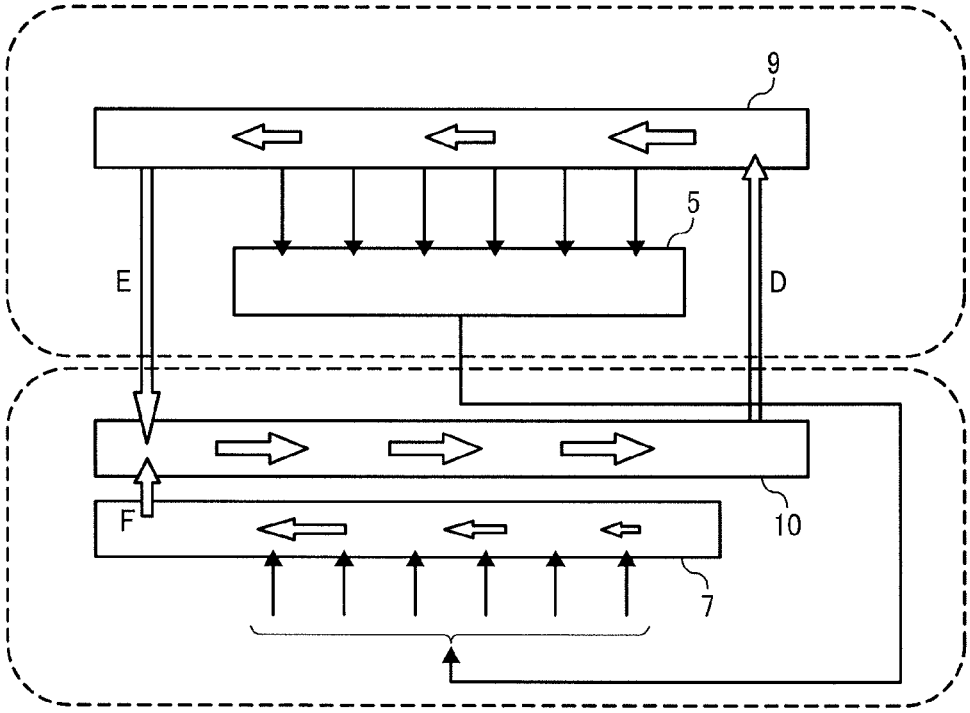
FIG. 11 is a schematic diagram illustrating the flow of the developing agent.

Next, a preferable configuration example of the developing device for use in the image forming method in some embodiments is described with reference to drawings. FIGS. 9-11 are diagrams illustrating the example of the developing method utilizing the developing agent supplying conveyor path, the developing agent retrieving conveyor path, and the developing agent stirring conveyor path, all of which are separated by separating members.

FIG. 9 is an enlarged diagram illustrating the developing device 4 and the photoconductor 1. As illustrated in FIG. 9, the surface of the photoconductor 1 is charged by a charging device while the photoconductor 1 is rotating in a direction G. Toner is supplied by the developing device 4 to a latent electrostatic image formed on the charged surface of the photoconductor 1 by exposure to a laser beam emitted from an irradiator to form a toner image.

The developing device 4 includes a development roller 5 serving as a developing device bearer to supply the developing agent to develop the latent electrostatic image on the surface of the photoconductor 1 while the surface of the development roller 5 moves in a direction I of FIG. 9. In addition, the developing device 4 includes a supply screw 8 serving as a developing agent supplying conveyor member to convey the developing agent towards the front direction as to FIG. 9 while supplying the developing agent to the developing roller 5.

The developing device 4 includes a doctor blade 12 serving as a developing agent regulating member to suitably regulate the thickness of the developing agent supplied to the developing roller 5 on the downstream side of the facing portion to the supply screw 8 in the surface moving direction.

On the downstream side of the development portion of the developing roller 5, which faces the photoconductor 1, in the surface moving direction, there is provided a retrieving screw 6 serving as a developing agent retrieving conveyor member to retrieve the developing agent passing through the development portion for development and convey the retrieved developing agent in the same direction as the supply screw 8. There are provided a supplying conveyor path 9 serving as the developing agent supply conveyor path including the supply screw 8 on the lateral side of the developing roller 5 and the retrieving conveyor path 7 serving as the developing agent retrieving conveyor path including the retrieving screw 6 below the developing roller 5.

The developing device 4 includes a stirring conveyor path 10 serving as the developing agent stirring conveyor path side by side with a retrieving conveyor path 7 and below the supplying conveyor path 9. The stirring conveyor path 10 includes a stirring screw 11 serving as the developing agent stirring conveyor member to convey the developing agent towards the rear direction in FIG. 9, which is opposite to the direction of the supply screw 8, while stirring the developing agent.

The supplying conveyor path 9 and the stirring conveyor path 10 are separated by a first separating wall 133 serving as the separating member. The portion of the first separating wall 133 separating the supplying conveyor path 9 and the stirring conveyor path is open at both ends on the rear and the front side of FIG. 9. The supplying conveyor path 9 and the stirring conveyor path 10 are communicating with each other.

Both the supplying conveyor path 9 and the retrieving conveyor path 7 are separated by the first separating wall 133. However, the portion of the first separating wall 133 separating the supplying conveyor path 9 and the retrieving conveyor path 7 have no open portions.

In addition, the stirring conveyor path 10 and the retrieving conveyor path 7 are separated by a second separating wall 134 serving as a separating member. The second separating wall 134 has an aperture on the front side of FIG. 9 to communicate the stirring conveyor path 10 and the retrieving conveyor path 7.

The supply screw 8, the retrieving screw 6, and the stirring screw 11 serving as the developing agent conveyor members are made of resins in this example. As one example, each screw has a diameter of 18 mm, a screw pitch of 25 mm, and a number of rotation of 600 rpm.

The developing agent on the developing roller 5 which is thinly regulated by the doctor blade 12 is conveyed to the development area facing the photoconductor 1 to conduct development. The surface of the developing roller 5 has a V-shape ditch or is treated with sand blast. As an example of the configuration, an aluminum tube having a diameter of 25 mm with a gap between the doctor blade 12 and the photoconductor 1 of about 0.3 mm.

The developing agent after development is retrieved at the retrieving conveyor path 7, conveyed towards the front side of the cross section of FIG. 9, and moved to the stirring conveyor path 10 at the aperture of the first separating wall 133 disposed at the non-imaging portion. Near the aperture of the first separating wall 133 on the upstream side of the stirring conveyor path 10 in the developing agent conveying direction, the toner is supplied from a toner supplying opening disposed above the stirring conveyor path 10 to the stirring conveyor path 10.

Next, the circulation of the developing agent in the three developing agent conveyor paths is described next.

FIG. 10 is a perspective cross section of the developing device 4 illustrating the flow of the developing agent in the developing agent conveyor path. Each arrow in FIG. 10 indicates the moving direction of the developing agent.

FIG. 11 is a schematic diagram illustrating the flow of the developing agent in the developing device 4 and each arrow in FIG. 11 indicates the moving direction of the developing agent like in FIG. 10.

At the supplying conveyor path 9 where the developing agent is supplied from the stirring conveyor path 10, the developing agent is conveyed downstream in the conveying direction of the supply screw 8 while the developing agent is supplied to the development roller 5. Extra developing agent, which has been used for development but conveyed to the end of the downstream of the supplying conveyor path 9 in the conveying direction, is thereafter supplied to the stirring conveyor path 10 from the aperture of the first separating wall 133 in the direction indicated by an arrow E in FIG. 11.

The retrieved developing agent is sent from the developing roller 5 to the retrieving conveyor path 7, conveyed to the end of the downstream of the retrieving conveyor path 7 by the retrieving screw 6. Thereafter the retrieved developing agent is supplied to the stirring conveyor path 10 from the aperture of the second separating wall 134 in the direction indicated by an arrow F in FIG. 11.

In the stirring conveyor path 10, the supplied residual developing agent and the supplied retrieved developing agent are stirred and conveyed to downstream of the stirring screw 11 in the conveying direction and upstream of the supply screw 8 in the conveying direction and thereafter supplied to the supplying conveyor path 9 from the aperture of the first separating wall 133 in the direction indicated by an arrow D in FIG. 11.

In the stirring conveyor path 10, the retrieved developing agent, the residual developing agent, and the toner replenished on a necessity basis at a conveying portion are stirred and conveyed by the stirring screw 11 in the opposite direction of the developing agent in the retrieving conveyor path 7 and the supplying conveyor path 9. Thereafter, the stirred developing agent is conveyed upstream in the conveying direction of the supplying conveyor path 9 which is communicating with the stirring screw 11 on the downstream side. In addition, below the stirring conveyor path 10 is provided a toner concentration sensor. Due to the output from the sensor, a toner replenishing control device is operated to supply toner from the toner accommodating unit.

The developing device 4 illustrated in FIG. 11 includes the supplying conveyor path 9 and the retrieving conveyor path 7. That is, the developing agent is supplied and retrieved using the separated developing agent conveyor paths, so that the developing agent already used for development has no chance of being mixed in the supplying conveyor path 9. Therefore, it is possible to prevent the concentration of toner supplied to the developing roller 5 from decreasing as the developing agent moves further downstream in the conveying direction of the supplying conveyor path 9.

Additionally, the developing device 4 includes the retrieving conveyor path 7 and the stirring conveyor path 10. That is, the developing agent is supplied and retrieved using the separated developing agent conveyor paths, so that the developing agent already used for development does not drop into the middle of stirring. Accordingly, the developing agent already sufficiently stirred is supplied to the supplying conveyor path 9, so that the developing agent supplied to the supplying conveyor path 9 is prevented from being insufficiently stirred.

As described above, the toner concentration of the developing agent in the supplying conveyor path 9 is prevented from decreasing and the developing agent in the supplying conveyor path 9 is sufficiently stirred, so that the image density is kept constant during development.

Figure 12:
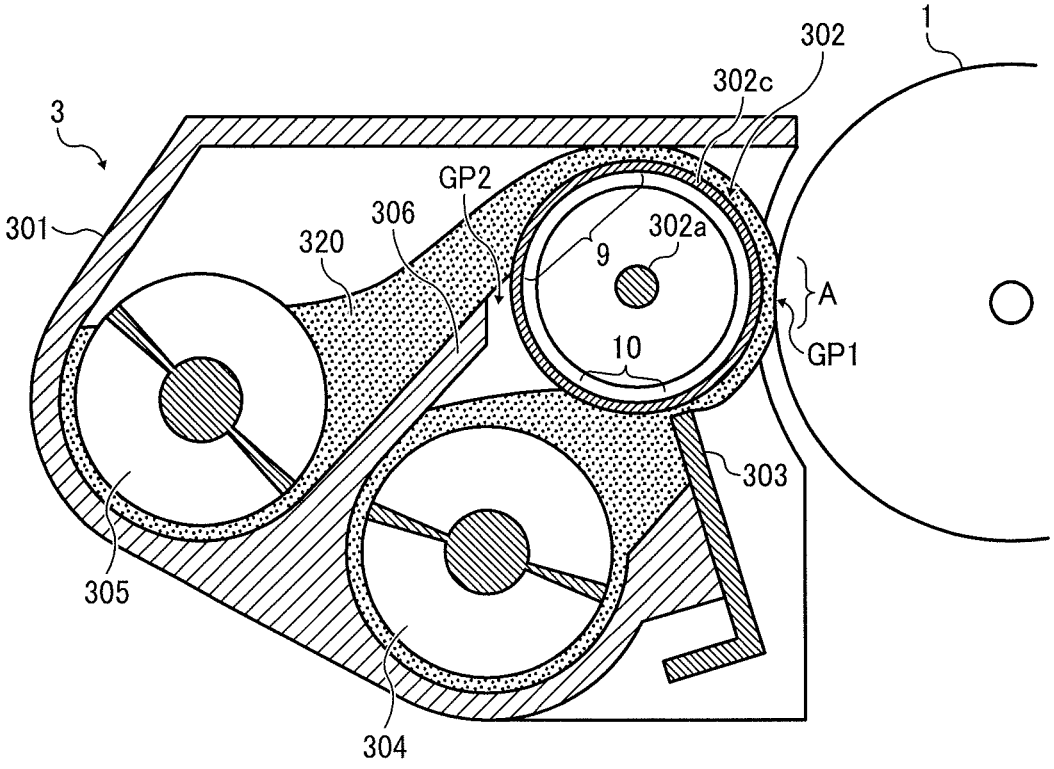
FIG. 12 is a schematic diagram illustrating still another example of the developing device.

FIG. 12 is a schematic diagram illustrating an example of the configuration of respective members around the photoconductor 1 using a developing device 3 for use in the present disclosure In FIG. 12, the developing agent stirring conveyor path is omitted.

The developing device 3 includes a developing agent supplying conveying member 304 to stir and convey a developing agent 320 in the developing agent supplying conveyor path, a developing agent retrieving conveyor member 305 to convey in the developing agent retrieving conveyor path, rotating members such as a developing roller 302, and other optional members in a casing 301. The developing roller 302 has significantly the same length in the longitudinal direction as the photoconductor 1.

The developing roller 302 is closely disposed facing the photoconductor 1 to form a development nip area A. The portion of the casing 301 corresponding to the facing portion of the photoconductor 1 has an opening to protrude the developing roller 302.

The developing roller 302 conveys the developing agent 320 in the casing 301 to the development nip area A. Toner in the developing agent 320 is attached to a latent electrostatic image formed on the surface of the photoconductor 1 in the development nip area A to render the latent electrostatic image visible as a toner image.

The developing device 3 includes the developing roller 302, the developing agent supplying conveying member 304, the developing agent retrieving conveying member 305, and a developing agent regulating member 303 in the casing 301 to circulate the developing agent 320 while stirring and conveying the developing agent 320.

A sleeve 302C positioned circularly around the developing roller 302 is made of non-magnetic metal such as aluminum. A magnet roller 302*d* is fixed to an immovable member such as the casing 301 to direct each magnet in predetermined directions. The sleeve 302*c* rotates around the magnet roller 302*d* to convey the developing agent 320 attracted by multiple magnets disposed in the circumference direction of the magnet roller 302*d* disposed inside the developing roller 302.

The developing roller 302 and the photoconductor 1 in the development nip area A are not directly in contact with each other bur with a constant development gap GP1 suitable for development.

The developing agent 320 is held on the developing roller 302 like a filament to cause the developing agent 320 to contact with the photoconductor 1 so that the toner is caused to adhere to the latent electrostatic image on the surface of the photoconductor 1, thereby rendering the image visible.

The developing device 3 includes a fixed shaft 302*a* with which a grounded power source for bias is connected. The voltage of the power source connected with the fixed shaft 302*a* is applied to the sleeve 302*c*. The electroconductive substrate constituting the lowermost layer constituting the photoconductor 1 is grounded.

In this way, an electric field by which the toner detached from the carrier is moved towards the photoconductor 1 is formed on the development nip area A. The toner is moved by the electric field towards the photoconductor 1 due to the voltage difference between the sleeve 302*c* and the latent electrostatic image formed on the surface of the photoconductor 1.

The developing device is combined with an image forming apparatus employing a drawing (scanning) method with exposure light. Negatively-charged charges are uniformly placed on the photoconductor 1 by a charging device 2. Text portions are exposed to light for irradiation to reduce the amount of drawing (writing). The text portion (latent electrostatic image) having a lowered voltage is developed with the negatively-charged toner, which is so-called reversal development method. This is just an example and the polarity of the charge placed on the photoconductor 1 does not matter to the developing method of the present disclosure.

After the development, the developing agent 320 borne on the developing roller 302 is conveyed downstream in accordance with the rotation of the developing roller 302 and drawn into the casing 301. The casing 301 is partially curved closely tracing the periphery of the sleeve 302*c* to prevent toner scattering by a sealing effect.

The developing agent drawn into the casing 301 is subject to "agent detaching" to detach the developing agent 320 attracted around the developing roller 302 from the developing roller 302, which forms an agent detaching area 9 of FIG. 9.

After the toner is attached to the photoconductor 1, the toner concentration of the developing agent 320 lowers. If this developing agent having a lower toner concentration is not detached from the developing roller 302 but conveyed again to the development nip area A for development, the target image density is not obtained.

To prevent this drawback, the developing agent 320 is detached from the developing roller 302 at the agent detaching area 9 after development. Thereafter, the developing agent detached from the developing roller 302 is stirred and mixed in the developing agent stirring conveyor path to obtain target toner concentration and toner charging size.

The developing agent having such a target toner concentration and a target charging size is drawn up to the developing roller 302 at an agent draw-up area 10 on the developing roller 302. While the developing agent attracted, so called drawn up, to the developing roller 302 passes the developing agent regulating member 303, a magnetic brush having a predetermined thickness is formed and conveyed to the development nip area A.

Figure 13:
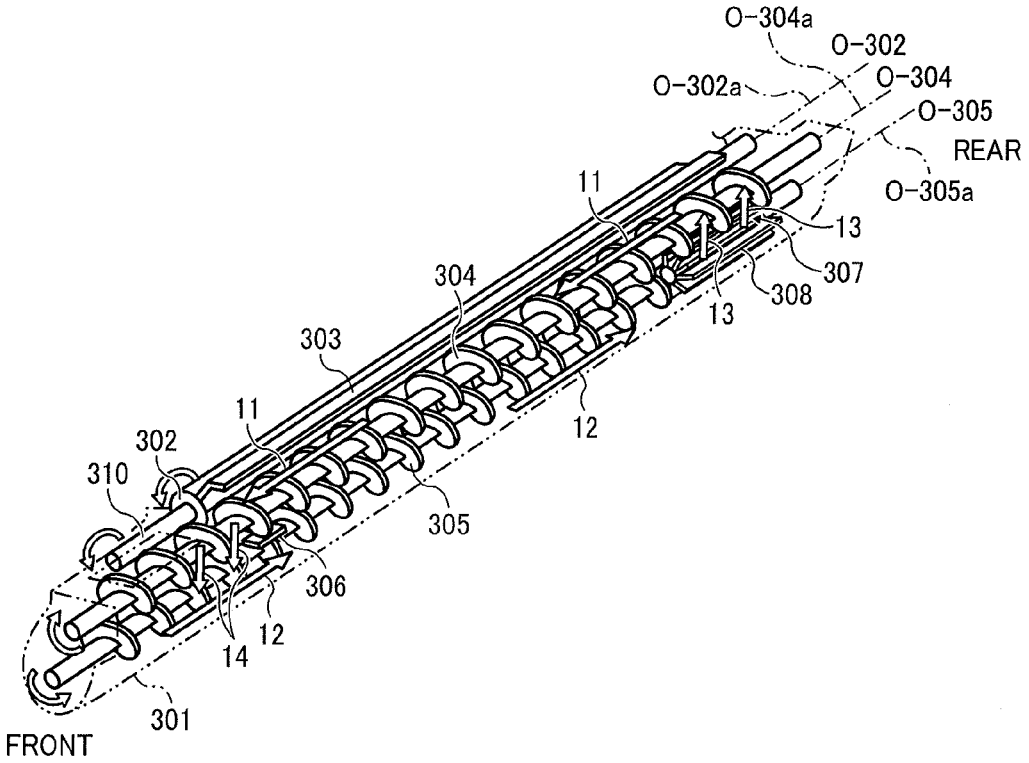
FIG. 13 is a schematic diagram illustrating further another example of the developing device.
Figure 14:
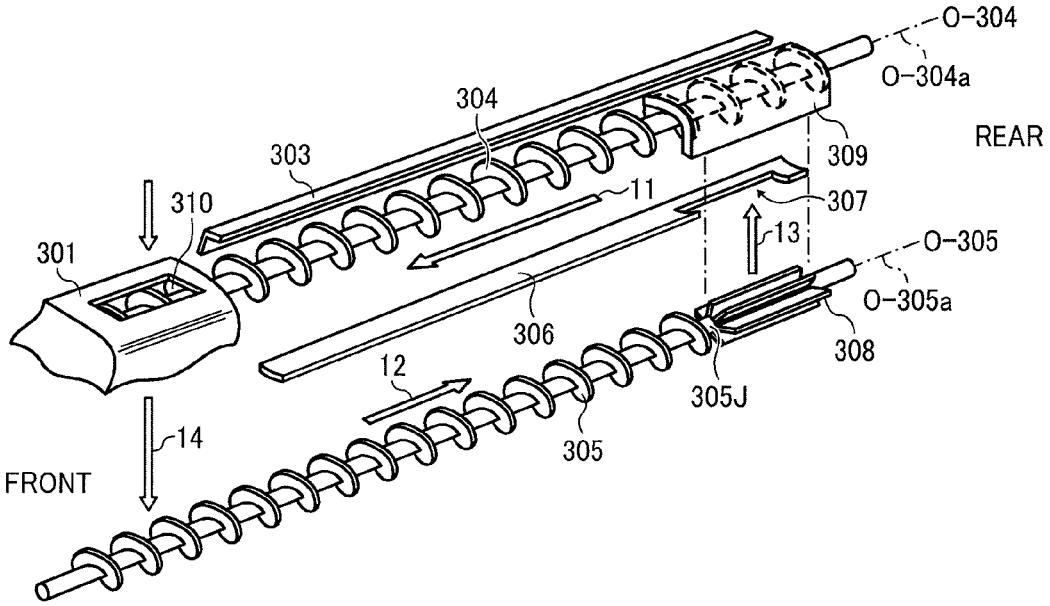
FIG. 14 is a schematic diagram illustrating furthermore another example of the developing device.

Configuration and disposition of each member are described with reference to FIG. 13 illustrating the configuration inside the developing device in an assembled state and FIG. 14 illustrating that in an exploded state. FIGS. 13 and 14 are respectively a schematic diagram illustrating a perspective diagram and an exploded perspective view of an example of the developing device for use in the present disclosure in an assembled state.

As illustrated in FIG. 12, the developing agent supplying conveyor member 304 is disposed in the vicinity of the draw-up area 10 of the developing roller 302. This position is upstream of the developing agent regulating member 303. As illustrated in FIGS. 13 and 14, the developing agent supplying conveyor path 304 has a screw-like shape with a spiral around the rotation shaft and rotates around the center line O-302*a* piercing through the center O-302 of the developing roller 302 and a parallel center line O-304*a*. The developing agent is stirred and conveyed from the rear end of the center line O-304*a* to the front end thereof in the longitudinal direction as indicated by arrows 11.

The developing agent supplying conveyor member 304 conveys the developing agent in the axis direction by the rotation of the rotation shaft.

The end portions on the rear sides of the developing agent supplying conveyor member 304 and the developing agent retrieving conveyor member 305 are placed slightly towards the rear end in comparison with the end portion on the rear side of the developing roller 302 to secure supplying of the developing agent at the end portion on the read side of the developing roller 302. In addition, the end portions on the front sides of the developing agent supplying conveyor member 304 and the developing agent retrieving conveyor member 305 are positioned slightly towards the front end in comparison with the end portion on the front side of the developing roller 302 to secure a space for replenishing of the toner, which is described later. The developing agent regulating member 303 is disposed to suit to the length of the developing roller 302.

A separating board 306 is situated between the developing agent supplying conveyor member 304 and the developing agent retrieving conveyor member 305 to separate the space around the developing agent supplying conveyor member 304 from the space around the developing agent retrieving conveyor member 305 at the center portion of the developing roller 302 in the longitudinal direction excluding both end portions. The separating board 306 is integrally shaped with the inside wall of the casing 301 on the side on which the casing 301 is away from the developing roller 302 to support like a cantilever.

The separating board 306 is located at the center portion excluding both end portions in the longitudinal direction of the developing roller 302 with no portion corresponding to both end portions of the developing roller 302 in the longitudinal direction. Each of the end portions in the longitudinal direction of the developing agent supplying conveyor member 304 and the developing agent retrieving conveyor member 305 covers both end portions in the longitudinal direction of the developing roller 302.

The reason why the separating board 306 is located at the center portion excluding both end portions in the longitudinal direction of the developing roller 302 is to make it possible to flow the developing agent at the end portions in the longitudinal direction to constitute a circulation conveyor path on the whole.

In the embodiment illustrated in FIGS. 13 and 14, the separating board 306 includes an opening 307 around the end portion on the rear side. The developing agent is moved from the developing agent stirring conveyor path to the developing agent supplying conveyor path via the opening 307. Therefore, the separating board 306 may extend to the end portion on the rear side in the longitudinal direction of the developing roller 302.

At the center portion excluding both end portions in the longitudinal direction of the developing roller 302, the separating board 306 separates the space around the developing agent supplying conveyor member 304 from the space around the developing agent retrieving conveyor member 305. For this reason, only the developing agent 320 in which the toner and the carrier have been sufficiently stirred and mixed by the supplying conveyor member 304 is supplied to the developing roller 302. Therefore, the developing agent having a lowered toner concentration is exclusively conveyed by the developing agent retrieving conveyor member 305 but not directly supplied to the developing roller 302. As a consequence, only the toner having a target charging size is used for development in the developing roller 302, so that high image quality is obtained.

To secure the function of the separating board 306, it is preferable to set a separating board gap GP2 between the periphery of the developing roller 302 and the separating board 306 of about 0.2-about 1 mm. When the separating board gap GP2 is less than 0.2 mm, eccentricity during rotation of the developing roller 302 causes the separating board 306 to bump into the developing roller 302. When the separating board gap GP2 is greater than 1 mm, Ability to serve as the filament of the magnet brush tends to be incomplete. Therefore, the position of the separating 306 can be positioned at any position of the agent detaching area 9 in terms of function of the separating 306. That is, freedom of setting the position of the separating board is increased.

Moreover, if the separating board 306 is off from the agent detaching area 9, the separating board 306 can serve as a separating board. However, if the separating board 306 is set off from the agent detaching area 9, the separating board 306 may regulate the massive amount of the developing agent, which is not preferable because a large stress is applied to the developing agent.

It is thinkable that the agent detaching area 9 is positioned around the developing roller 302 on the opposite side of the photoconductor 1 and the agent draw-up area 10 is positioned adjacent to the agent detaching area 9 on the downstream side of the agent detaching area 9 in the rotation direction of the developing roller 302. In such a case, a preferable configuration is that the separating board 306 is disposed at a position between the agent detaching area 9 and the agent draw-up area 10 where the attachment amount of the developing agent is least around the developing roller 302 in order to separate the space of the developing agent supplying conveyor path from the space of the developing agent stirring conveyor path while the end portion of the separating board 306 on the side of the developing roller 302 is caused to face the developing roller 302.

In this configuration, the separating board 306 demonstrates its function since the attachment amount of the developing agent is least around the developing roller 302 at the portion where this separating board is disposed even if the separating board gap GP2 of 0.2-1 mm is not set. In addition, the stress applied to the developing agent can be least due to the regulation of the separating board 306. That is, the gap control at the time of setting a separating board can be relaxed. However, if the condition of setting the separating board gap GP2 of 0.2-1 mm is added, it is possible to apply less stress to the developing agent.

The developing agent supplying conveyor member 304 is preferably rotated in the opposite direction of the developing roller 302. In general, screws cause a conveyed material closer to the rotation direction while conveying the conveyed material in the axis direction, so that the developing agent supplying conveyor member 304 conveys the developing agent 320 in the developing agent supplying conveyor path while pulling the developing agent 320 closer to the developing roller 302. Therefore, the developing agent can be continuously supplied to the developing roller 302.

Toner is required to be replenished to the developing agent 320 in the developing device 3 from outside since the toner is consumed in the repetition of the development operations. If toner is replenished from outside, for example, the end portion on the upstream side of the developing agent stirring conveyor path, i.e., the replenishment unit of the developing agent disposed near the end portion on the front side of the developing device, the toner replenished is not immediately used for development but stirred in the developing agent stirring conveyor member so that the toner stably having a predetermined toner concentration is used for development.

The toner is not supplied to the developing roller 302 from the developing agent stirring conveyor path. For this reason, no developing agent which is insufficiently stirred due to toner replenished from the opening 310 and has a non-uniform toner concentration is supplied for development.

The replenished toner is conveyed to the rear side of the developing device 3 while being stirred and mixed with the developing agent 320 with a lower toner concentration which is away from the developing roller 302. Due to this operation, the toner concentration is regained. Thereafter, the developing agent 320 is conveyed towards the front side by the developing agent supplying conveyor member 304 and supplied to the developing roller 302 for development.

The developing device 3 conveys the developing agent 320 conveyed by the developing agent supplying conveyor member 304 towards the front side and draws up to the developing roller 302. After the developing agent 320 is drawn up to the developing roller 302, brought into contact with the photoconductor 1 via the magnetic brush, and used for development, the developing agent 320 is detached from the developing roller 302 in the developing device 3 at the agent detaching area 9 and conveyed towards the front side by the developing agent retrieving conveyor member 305.

Process Cartridge

Figure 15:
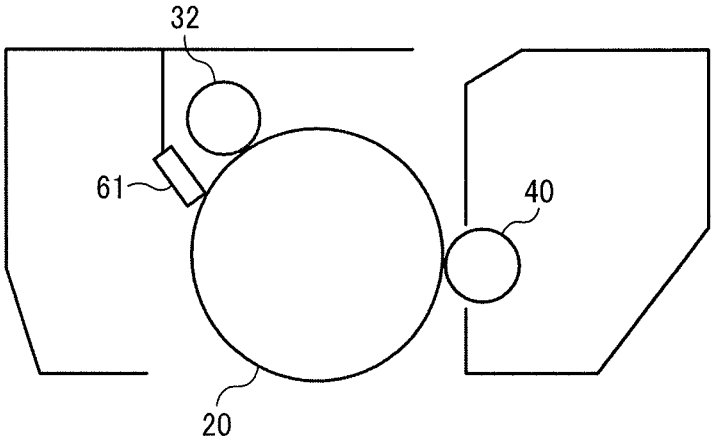
FIG. 15 is a schematic diagram illustrating an example of the process cartridge according to an embodiment of the present disclosure.

FIG. 15 is a diagram illustrating an example of the process cartridge of the present disclosure. This process cartridge integrally includes the photoconductor 20, a non-contact type charging member 32 having a brush-like shape, a developing device 40 to accommodate the developing agent of the present disclosure, and a cleaning device including a cleaning blade 61. The process cartridge is detachably mountable to an image forming apparatus. In the present disclosure, any of the elements described above can be integrally united in the process cartridge, which is detachably mountable to an image forming apparatus such as a photocopier and a printer.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present disclosure is described taking Examples and Comparative Examples. However, the present disclosure is not limited to these examples.

Manufacturing of Toner

Synthetic Example 1 of Binder Resin

The following components were placed in a reaction container equipped with a condenser, a stirrer, and a nitrogen introducing tube to conduct a reaction at 230 degrees C. at normal pressure for 8 hours followed by another reaction for 5 hours with a reduced pressure of 10-15 mmHg. Subsequent to cooling down to 160 degrees C., 32 parts of phthalic anhydride was added to conduct reaction for two hours.

Adduct of bisphenol A with 2 moles of ethylene oxide: 724 parts
Isophthalic acid: 276 parts
Dibutyl tin oxide: 2 parts Subsequent to cooling down to 80 degrees C., the resultant was caused to react with 188 parts of isophorone diisocyanate in ethyl acetate for two hours to obtain a prepolymer P1 containing isocyanate.

Thereafter, 267 parts of the prepolymer P1 and 14 parts of isophoronediamine were caused to react at 50 degrees C. for two hours to obtain a urea-modified polyester U1 having a weight average molecular weight of 64,000.

724 parts of an adduct of bisphenol A with 2 moles of ethylene oxide and 276 parts of terephthalic acid were condensed-polymerized at 230 degrees C. for 8 hours at a normal pressure as described above. Subsequently, the reaction was continued for 5 hours with a reduced pressure of 10 to 15 mmHg to obtain a non-modified polyester E1 having a peak molecular weight of 5,000.

200 parts of the urea-modified polyester U1 and 800 parts of the non-modified polyester E1 were dissolved and mixed in 2,000 parts of a solvent mixture of ethyl acetate and methylethylketone (MEK) with a mixing ratio of 1 to 1 to obtain a solution of ethyl acetate and MEK of a binder resin B1. Part of the solution was dried with a reduced pressure to isolate the binder resin B1. The glass transition temperature Tg of the binder resin B1 was 62 degrees C.

Synthesis Example A of Polyester Resin

Terephthalic acid: 60 parts
Dodecenyl succinic anhydride: 25 parts
Trimellitic anhydride: 15 parts
Bisphenol A (2,2) propylene oxide: 70 parts
Bisphenol A (2,2) ethylene oxide: 50 parts The composition specified above was charged in a four-necked flask (1 L) equipped with a thermometer, a stirrer, a condenser, and a nitrogen gas introducing tube. This flask was set on a mantle heater. Nitrogen gas was introduced into the flask through the nitrogen gas introducing tube and the temperature of the system was risen while keeping the inside of the flask in the inert gas atmosphere. Subsequently, 0.05 g of dibutyltin oxide was added to conduct reaction while keeping the temperature at 200 degrees C. to obtain a polyester resin A.

The glass transition temperature Tg of the polyester resin A was 60 degrees C. and the number average molecular weight (Mn) was 3,800.

Synthesis Example B of Polyester Resin 443 parts of an adduct of bisphenol A with polyethylene oxide (PO) (hydroxyl value: 320), 135 parts of diethylene glycol, 422 parts of terephthalic acid, and 2.5 parts of dibutyl tin oxide were charged in a reaction container equipped with a thermometer, a stirrer, a condenser, and a nitrogen introducing tube to conduct reaction at 200 degrees C. until the acid value reached 10 to obtain a polyester resin B.

The glass transition temperature Tg of the polyester resin B was 63 degrees C. and the number average molecular weight (Mn) was 6,000.

Synthesis Example C of Polyester Resin 443 parts of an adduct of bisphenol A with polyethylene oxide (PO) (hydroxyl value: 320), 135 parts of diethylene glycol, 422 parts of terephthalic acid, and 2.5 parts of dibutyl tin oxide were charged in a reaction container equipped with a thermometer, a stirrer, a condenser, and a nitrogen introducing tube to conduct reaction at 230 degrees C. until the acid value reached 7 to obtain a polyester resin C.

The glass transition temperature Tg of the polyester resin C was 65 degrees C. and the number average molecular weight (Mn) was 16,000.

Manufacturing Example 1 of Master Batch

Pigment (C.I. Pigment Yellow 155): 40 parts
Binder resin (Polyester resin A): 60 parts
Water: 30 parts The raw material specified above was mixed in a HENSCHEL MIXER to obtain a mixture in which water was infiltrated into the pigment agglomerating body. The mixture was mixed and kneaded for 45 minutes by two rolls where the temperature of the surface was set at 130 degrees C. and thereafter pulverized by a pulverizer to the size of a diameter of 1 mm to obtain Master batch M1.

Manufacturing Example A of Toner 240 parts of the solution of ethylacetate and MEK of the binder resin B1, 20 parts of pentaerythritol tetrabehenate (melting point: 81 degrees C., melt viscosity: 25 cps), and 8 parts of the master batch M1 were placed in a beaker and stirred at 60 degrees C. by a TK type homomixer at 12,000 rotations per minute (rpm) for uniform dissolution and dispersion to prepare a toner liquid material.

The following was placed and uniformly dissolved in a beaker.

Deionized water: 706 parts 10 percent liquid suspension of hydroxyapatite: 294 parts (SUPER TIGHT 10, manufactured by Nippon Chemical Industrial CO., LTD.)

Dodecylbenzene sodium sulfate: 0.2 parts

Subsequently, the solution was heated to 60 degrees C. and the toner liquid material was charged in the beaker while being stirred at 12,000 rpm for 10 minutes by a TK type HOMOMIXER.

Thereafter, the liquid mixture was placed in a Kolben equipped with a stirring bar and a thermometer and heated to 98 degrees C. to remove the solvent. Subsequent to filtration, rinsing, and drying, a mother toner particle A was obtained.

Manufacturing Example B of Toner

Polyester Resin B: 40 parts

Polyester Resin C: 60 parts

Carnauba wax: 1 part

Carbon black (#44, manufactured by Mitsubishi Chemical Corporation): 10 parts

The toner composition material specified above was mixed with a HENSCHEL MIXER (at 1,500 rpm for three minutes by HENSHCEL MIXER 20B, manufactured by NIPPON COKE & ENGINEERING CO., LTD.) and mixed and kneaded by a single-shaft kneader (small type Buss Ko-Kneader™, manufactured by BUSS) under the following conditions.

Set Temperature: 100 degrees C. at entrance 50 degrees C. at exit

Amount of feed: 2 kg/h

Moreover, the resultant was subject to cold flatting and pulverized by a pulverizer. Thereafter, the resultant was finely-pulverized by an I-type mill (IDS-2 type, manufactured by Nippon Pneumatic Mfg. Co., Ltd.) using a flat surface type collision board under the conditions of an air pressure of 6.8 atm/cm$^2$ and a feed amount of 0.5 kg/h, followed by classification (by 132MP, manufactured by Alpine) to obtain a mother toner particle B.

Manufacturing Example C of Toner

A mother toner particle C was obtained in the same manner as in Manufacturing Example B of Toner except that carbon black was changed to 50 parts of titanium oxide.

Manufacturing Example D of Toner

A mother toner particle D was obtained in the same manner as in Manufacturing Example B of Toner except that no carbon black was prescribed.

100 parts of the mother toner particle A, the mother toner particle B, the mother toner particle C, and the mother toner particle D was respectively mixed with 1.0 part of hydrophobized silica and 1.0 part of hydrophobized titanium oxide by HENSCHEL MIXER to obtain a toner A, a toner B, a toner C, and a toner D.

The diameter of each toner was measured by a particle size measuring instrument (Coulter Counter TA2, manufactured by Beckman Coulter, Inc.) with an aperture diameter of 100 μm. The toner A had a volume average particle diameter (Dv) of 6.2 μm and a number average particle diameter (Dn) of 5.1 μm. The toner B, toner C, and toner D had a volume average particle diameter of 6.9 μm and a number average particle diameter (Dn) of 6.1 μm.

The circularity was measured by a flow type particle size analyzer (FPIA-1000, manufactured by Sysmex Corporation) as the average circularity. The specific measuring procedure was as follows: 0.1 to 0.5 ml of a surfactant (alkylbenzenesulfonic acid salt) serving as a dispersant was added to 100 to 150 ml of water from which solid impurities was preliminarily removed; about 0.1 to about 0.5 g of a measuring sample was added followed by dispersion treatment for about one to about three minutes by an ultrasonic dispersing instrument to prepare a liquid for measuring having a concentration of liquid dispersion of 3,000-10,000 particles/μl. The circularity of the toner A was 0.96. The circularity of the toner B, the toner C, and the toner D was 0.94.

Manufacturing of Carrier

Manufacturing Example 1

Liquid Resin a

- Acrylic resin solution (Solid portion: 20 percent): 200 parts
- Silicone resin solution (Solid portion: 40 percent): 2,000 parts
- Amino silane (Solid portion: 100 percent): 10 parts
- Carbon (Ketjen black): 80 parts
- Barium sulfate (volume average particle diameter: 0.60 μm): 1,000 parts
- Toluene: 6,000 parts Liquid Resin b

- Acrylic resin solution (Solid portion concentration: 20 percent by mass): 200 parts
- Silicone resin solution (Solid portion concentration: 40 percent): 2,000 parts
- Amino silane (Solid portion concentration: 100 percent): 10 parts
- Alumina having surface treated with indium tin oxide (ITO): (powder specific resistance: 20 Ω·cm) 800 parts
- Barium sulfate (volume average particle diameter: 0.60 μm): 1,000 parts
- Toluene: 6,000 parts The material specified above of each of the liquid resin a and the liquid resin b was dispersed by a HOMOMIXER for 10 minutes to prepare a resin layer forming liquid. Using Cu—Zn ferrite having a particle diameter of 35 μm as carrier core material, the liquid resin a was coated in 55 degree C. atmosphere at a rate of 30 g/min by a SPIRACOTA (manufactured by OKADA SEIKO CO., LTD.) in such a manner that the thickness of the surface of the core material was 0.20 μm. Thereafter, the liquid resin b was coated in the same manner and dried. The thickness was adjusted by the liquid amount. The thus-obtained carrier was rest in an electric furnace at 150 degrees C. for an hour and thereafter baked.

Subsequent to cooling down, the resultant was pulverized using a sieve having an opening of 100 μm to obtain a carrier 1. The average thickness T representing the thickness between the surface of the core material and the surface of the coating layer was 0.40 μm.

The volume average particle diameter of the core material was measured by a microtrac particle size analyzer (SRA type, manufactured by NIKKISO CO., LTD.) in the range of 0.7-125 μm.

The thickness T (μm) from the surface of the core material to the surface of the coating layer was obtained by observing the cross section of the carrier by a transmission electron microscope (TEM) and measuring the thickness t at 50 points spaced 0.2 μm therebetween along the surface of the carrier. The obtained values were averaged to obtain the thickness T.

Manufacturing Example 2

A carrier 2 was obtained in the same manner as in the Manufacturing Example 1 except that the liquid amount was adjusted to have a thickness of the liquid resin a of 0.36 μm and a thickness of the liquid resin b of 0.04 μm.

Manufacturing Example 3

A carrier 3 was obtained in the same manner as in the Manufacturing Example 1 except that the liquid amount was adjusted to have a thickness of the liquid resin a of 0.04 μm and a thickness of the liquid resin b of 0.36 μm.

Manufacturing Example 4

Liquid Resin c
- Acrylic resin solution (Solid portion concentration: 20 percent): 200 parts
- Silicone resin solution (Solid portion concentration: 40 percent): 2,000 parts
- Amino silane (Solid portion concentration: 100 percent): 10 parts
- Alumina having surface treated with indium tin oxide (ITO) (powder specific resistance: 20 Ω·cm): 400 parts
- Carbon (Ketjen black): 40 parts
- Barium sulfate (volume average particle diameter: 0.60 μm): 1,000 parts
- Toluene: 6,000 parts A carrier 4 was obtained in the same manner as in the Manufacturing Example 1 except that the liquid resin b was changed to the liquid resin c.

Manufacturing Example 5

Liquid Resin d
- Acrylic resin solution (Solid portion concentration: 20 percent): 200 parts
- Silicone resin solution (Solid portion concentration: 40 percent): 2,000 parts
- Amino silane (Solid portion concentration: 100 percent): 10 parts
- Alumina having surface treated with indium tin oxide (ITO) (powder specific resistance: 20 Ω·cm): 300 parts
- Carbon (Ketjen black): 50 parts
- Barium sulfate (volume average particle diameter: 0.60 μm): 1,000 parts
- Toluene: 6,000 parts A carrier 5 was obtained in the same manner as in the Manufacturing Example 1 except that the liquid resin b was changed to the liquid resin d.

Manufacturing Example 6

Liquid Resin e
- Acrylic resin solution (Solid portion concentration: 20 percent): 400 parts
- Silicone resin solution (Solid portion concentration: 40 percent): 4000 parts
- Amino silane (Solid portion concentration: 100 percent): 20 parts
- Alumina having surface treated with indium tin oxide (ITO): (powder specific resistance: 20 Ω·cm) 800 parts
- Carbon (Ketjen black): 80 parts
- Barium sulfate (volume average particle diameter: 0.60 μm): 2,000 parts
- Toluene: 12,000 parts A carrier 6 was obtained in the same manner as in the Manufacturing Example 1 except that as the liquid resin, only the liquid resin e was used for coating in such a manner that the average thickness of the coating layer was 0.40 μm.

Manufacturing Example 7

Liquid Resin f
- Acrylic resin solution (Solid portion concentration: 20 percent): 200 parts
- Silicone resin solution (Solid portion concentration: 40 percent): 2,000 parts
- Amino silane (Solid portion concentration: 100 percent): 10 parts
- Alumina having surface treated with phosphorus tin oxide (PTO): (powder specific resistance: 190 Ω·cm) 800 parts
- Barium sulfate (volume average particle diameter: 0.60 μm): 1,000 parts
- Toluene: 6,000 parts A carrier 7 was obtained in the same manner as in the Manufacturing Example 1 except that the liquid resin b was changed to the liquid resin f.

Manufacturing Example 8

Liquid Resin g
- Acrylic resin solution (Solid portion concentration: 20 percent): 200 parts
- Silicone resin solution (Solid portion concentration: 40 percent): 2,000 parts
- Amino silane (Solid portion concentration: 100 percent): 10 parts
- Alumina having surface treated with phosphorus tin oxide (PTO): (powder specific resistance: 210 Ω·cm) 1,000 parts
- Barium sulfate (volume average particle diameter: 0.60 μm): 1,000 parts
- Toluene: 6,000 parts A carrier 8 was obtained in the same manner as in the Manufacturing Example 1 except that the liquid resin b was changed to the liquid resin g.

Manufacturing Example 9

Liquid Resin h
- Acrylic resin solution (Solid portion concentration: 20 percent): 200 parts Silicone resin solution (Solid portion concentration: 40 percent): 2,000 parts Amino silane (Solid portion concentration: 100 percent): 10 parts Alumina having surface treated with tungsten tin oxide (TTO): (powder specific resistance: 40 Ω·cm) 800 parts Barium sulfate (volume average particle diameter: 0.60 μm): 1,000 parts Toluene: 6,000 parts A carrier 9 was obtained in the same manner as in the Manufacturing Example 1 except that the liquid resin b was changed to the liquid resin h.

Manufacturing Example 10

Liquid Resin i

Acrylic resin solution (Solid portion concentration: 20 percent): 200 parts

Silicone resin solution (Solid portion concentration: 40 percent): 2,000 parts

Amino silane (Solid portion concentration: 100 percent): 10 parts

Alumina having surface treated with tin oxide: (powder specific resistance: 189 Ω·cm) 800 parts Barium sulfate (volume average particle diameter: 0.60 μm): 1,000 parts Toluene: 6,000 parts A carrier 10 was obtained in the same manner as in the Manufacturing Example 1 except that the liquid resin b was changed to the liquid resin i.

Manufacturing Example 11

A carrier 11 was obtained in the same manner as in the Manufacturing Example 1 except that the volume average particle diameter of barium sulfate was changed to 0.85 μm.

Manufacturing Example 12

A carrier 12 was obtained in the same manner as in the Manufacturing Example 1 except that the volume average particle diameter of barium sulfate was changed to 0.35 μm.

Manufacturing Example 13

A carrier 13 was obtained in the same manner as in the Manufacturing Example 1 except that barium sulfate was changed to zinc oxide having a volume average particle diameter of 0.65 μm.

Manufacturing Example 14

A carrier 14 was obtained in the same manner as in the Manufacturing Example 1 except that barium sulfate was changed to magnesium oxide having a volume average particle diameter of 0.55 μm.

Manufacturing Example 15

A carrier 15 was obtained in the same manner as in the Manufacturing Example 1 except that barium sulfate was changed to magnesium hydroxide having a volume average particle diameter of 0.61 μm.

Manufacturing Example 16

A carrier 16 was obtained in the same manner as in the Manufacturing Example 1 except that barium sulfate was changed to hydrotalcite having a volume average particle diameter of 0.58 μm.

Manufacturing Example 17

A carrier 17 was obtained in the same manner as in the Manufacturing Example 1 except that the volume average particle diameter of barium sulfate was changed to alumina having a volume average particle diameter of 0.62 μm.

Each of the carriers is shown in Table 1.

TABLE 1

| | Concentration gradient of carbon black and inorganic particulate A | Volume rate of carbon black (close to surface layer) (percent) | Inorganic particulate A | | Inorganic particulate B | | Average thickness T of coating layer (μm) |
|---|---|---|---|---|---|---|---|
| | | | Material | Powder specific resistance (Ω · cm) | Material | Average particle diameter (μm) | |
| Carrier 1 | Yes | 3 | ITO treated alumina | 20 | Barium sulfate | 0.60 | 0.40 |
| Carrier 2 | Yes | 28 | ITO treated alumina | 20 | Barium sulfate | 0.60 | 0.40 |
| Carrier 3 | Yes | 0 | ITO treated alumina | 20 | Barium sulfate | 0.60 | 0.40 |
| Carrier 4 | Yes | 27 | ITO treated alumina | 20 | Barium sulfate | 0.60 | 0.40 |
| Carrier 5 | Yes | 32 | ITO treated alumina | 20 | Barium sulfate | 0.60 | 0.40 |
| Carrier 6 | No | 24 | ITO treated alumina | 20 | Barium sulfate | 0.60 | 0.40 |
| Carrier 7 | Yes | 3 | PTO treated alumina | 190 | Barium sulfate | 0.60 | 0.40 |

TABLE 1-continued

| | Concentration gradient of carbon black and inorganic particulate A | Volume rate of carbon black (close to surface layer) (percent) | Inorganic particulate A Material | Inorganic particulate A Powder specific resistance (Ω · cm) | Inorganic particulate B Material | Inorganic particulate B Average particle diameter (μm) | Average thickness T of coating layer (μm) |
|---|---|---|---|---|---|---|---|
| Carrier 8 | Yes | 3 | PTO treated alumina | 210 | Barium sulfate | 0.60 | 0.40 |
| Carrier 9 | Yes | 3 | WITO treated alumina | 40 | Barium sulfate | 0.60 | 0.40 |
| Carrier 10 | Yes | 3 | Tin oxide surface-treated alumina | 189 | Barium sulfate | 0.60 | 0.40 |
| Carrier 11 | Yes | 3 | ITO treated alumina | 20 | Barium sulfate | 0.85 | 0.40 |
| Carrier 12 | Yes | 3 | ITO treated alumina | 20 | Barium sulfate | 0.35 | 0.40 |
| Carrier 13 | Yes | 3 | ITO treated alumina | 20 | Zinc oxide | 0.65 | 0.40 |
| Carrier 14 | Yes | 3 | ITO treated alumina | 20 | Magnesium oxide | 0.55 | 0.40 |
| Carrier 15 | Yes | 3 | ITO treated alumina | 20 | Magnesium hydroxide | 0.61 | 0.40 |
| Carrier 16 | Yes | 3 | ITO treated alumina | 20 | Hydrotalcite | 0.58 | 0.40 |
| Carrier 17 | Yes | 3 | ITO treated alumina | 20 | Alumina | 0.62 | 0.40 |

Example 1

7 parts of the toner A obtained in Manufacturing Example of Toner and 93 parts of the carrier 1 obtained in Manufacturing Example 1 of Carrier were stirred in the mixer for 10 minutes to prepare a developing agent 1-A.

The developing agent 1-A was set in a digital full color printer (imagio MPC4500, manufactured by Ricoh Company Ltd.) available on the market to output a text chart (one character having a size of about 2 mm×about 2 mm) having an image area of 5 percent with a run length of 100,000. The output text charts were evaluated in the following manner.

Evaluation Method

Durability

Durability was evaluated utilizing the reduction of the charging size and the change amount of the carrier resistance before and after the output of 100,000 sheets.

The reduction of the charging size was measured according to the following procedure.

The sample in which the initial carrier in an amount of 93 percent and the toner in an amount of 7 percent were mixed and triboelectrically charged was measured by a typical blow-off method using a blow-off device (TB-200, manufactured by Kyocera Chemical Corporation). The measuring result was defined as the initial charging size. Next, the toner was removed from the developing agent after the image output by the blow-off device. The thus-obtained 93 percent carrier was mixed with fresh toner in an amount of 7 percent. The sample triboelectrically charged in the same manner as the initial carrier was subject to measuring the charging size in the same manner as the initial carrier. The difference between the measuring result and the initial charging size was defined as the reduction of the charging size. The target value of the reduction of the charging size was within 10.0 μC/g.

The change amount of the carrier resistance was measured according to the following procedure.

Figure 16:
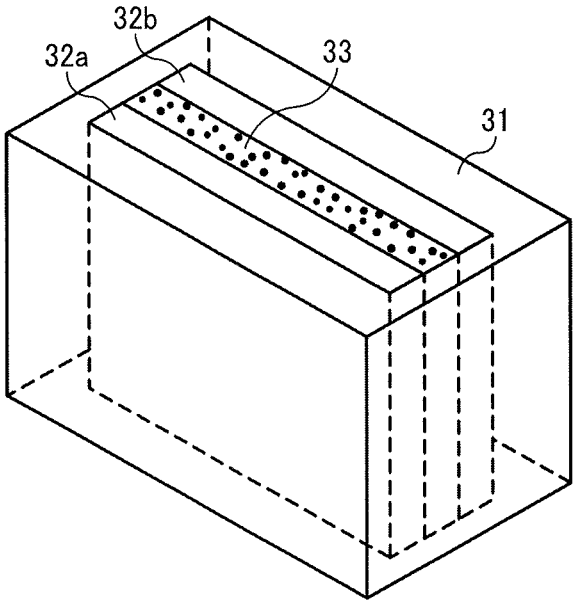
FIG. 16 is a schematic diagram illustrating a configuration of a carrier resistance measuring instrument to measure the volume specific resistance of the carrier according to an embodiment of the present disclosure.

A carrier 33 was charged in a cell 31 formed of a fluoro-resin container accommodating an electrode 32*a* and an electrode 32*b* serving as resistance measuring parallel electrodes with a gap of 2 mm therebetween and each has a specific surface of 2 cm×4 cm. A DC of 1,000 V was applied to a cell 31 (FIG. 16) and 30 seconds later the resistance was measured by a high resistance measuring instrument. The thus-obtained value was converted into volume resistance ratio, which was defined as the initial resistance. Next, the toner in the developing agent was removed by the blow-off device mentioned above. The resistance of the thus-obtained carrier was measured according to the same resistance measuring method as the resistance measuring method described above and the obtained value was converted into volume resistance ratio. The difference between the value and the initial resistance was defined as the change amount of the carrier resistance. The target value of the change amount of the carrier resistance was within the absolute value of 2.0 [Log(Ω·cm)].

Color Contamination

A solid image was output and measured by X-Rite (X-Rite 938 D50, manufactured by Amtec., Co. Ltd.). Specifically, a developing agent was set and an image obtained immediately after the developing agent was set was measured by the X-Rite. The measuring result was defined as E. An image was output after the output on 100,000 sheets and measured by the X-Rite. The measuring result was defined as E'. ΔE was obtained by the following relation and the developing agent was rated according to the following criteria.

$$\Delta E = E - E' \qquad \text{Relation 1}$$

In the Relation 1, $$E = \sqrt{(L^2 + a^{*2} + b^{*2})}$$

E=initial value

E'=value after output on 100,000 sheets

E (Excellent): ΔE≤2

G (Good): 2<ΔE≤5

P (Poor): 5<ΔE

Examples 2 to 4

A developing agent 1-B, a developing agent 1-C, and a developing agent 1-D of Examples 2-4 were prepared using the toner B, the toner C, and the toner D in the same manner as in Example 1 and evaluated in the same manner as in Example 1.

Examples 5 to 17 and Comparative Examples 1 to 3

Developing agents 2-A to 17-A of Examples 5-17 and Comparative Examples 1-3 were respectively prepared by using the carriers 2 to 17 and evaluated in the same manner as in Example 1.

The evaluation results of the combinations of the carriers and the toners of Examples and Comparative Examples are shown in Table 2.

TABLE 2

| | Developing agent | Carrier | Toner | Durability (charging) Before output [μC/g] | After output [μC/g] | Reduction amount [μC/g] |
|---|---|---|---|---|---|---|
| Example 1 | 1-A | Carrier 1 | Toner A | −28 | −26 | 2 |
| Example 2 | 1-B | Carrier 1 | Toner B | −25 | −22 | 3 |
| Example 3 | 1-C | Carrier 1 | Toner C | −26 | −24 | 2 |
| Example 4 | 1-D | Carrier 1 | Toner D | −29 | −26 | 3 |
| Example 5 | 2-A | Carrier 2 | Toner A | −24 | −19 | 5 |
| Example 6 | 3-A | Carrier 3 | Toner A | −31 | −29 | 2 |
| Example 7 | 4-A | Carrier 4 | Toner A | −24 | −21 | 3 |
| Comparative Example 1 | 5-A | Carrier 5 | Toner A | −22 | −19 | 3 |
| Comparative Example 2 | 6-A | Carrier 6 | Toner A | −25 | −14 | 11 |
| Example 8 | 7-A | Carrier 7 | Toner A | −30 | −23 | 7 |
| Comparative Example 3 | 8-A | Carrier 8 | Toner A | −33 | −29 | 4 |
| Example 9 | 9-A | Carrier 9 | Toner A | −28 | −26 | 2 |
| Example 10 | 10-A | Carrier 10 | Toner A | −29 | −26 | 3 |
| Example 11 | 11-A | Carrier 11 | Toner A | −24 | −20 | 4 |
| Example 12 | 12-A | Carrier 12 | Toner A | −23 | −17 | 6 |
| Example 13 | 13-A | Carrier 13 | Toner A | −25 | −22 | 3 |
| Example 14 | 14-A | Carrier 14 | Toner A | −29 | −26 | 3 |
| Example 15 | 15-A | Carrier 15 | Toner A | −27 | −24 | 3 |
| Example 16 | 16-A | Carrier 16 | Toner A | −29 | −27 | 2 |
| Example 17 | 17-A | Carrier 17 | Toner A | −22 | −15 | 7 |

| | Developing Agent | Carrier | Toner | Color contamination ΔE (rating) | Note |
|---|---|---|---|---|---|
| Example 1 | 1-A | Carrier 1 | Toner A | E | |
| Example 2 | 1-B | Carrier 1 | Toner B | E | Because of black toner, E value was low, color contamination restraint not apparent |
| Example 3 | 1-C | Carrier 1 | Toner C | E | |
| Example 4 | 1-D | Carrier 1 | Toner D | E | |
| Example 5 | 2-A | Carrier 2 | Toner A | G | |
| Example 6 | 3-A | Carrier 3 | Toner A | E | |
| Example 7 | 4-A | Carrier 4 | Toner A | G | |
| Comparative Example 1 | 5-A | Carrier 5 | Toner A | P | |
| Comparative Example 2 | 6-A | Carrier 6 | Toner A | P | |
| Example 8 | 7-A | Carrier 7 | Toner A | E | |
| Comparative Example 3 | 8-A | Carrier 8 | Toner A | G | |
| Example 9 | 9-A | Carrier 9 | Toner A | E | |
| Example 10 | 10-A | Carrier 10 | Toner A | G | |
| Example 11 | 11-A | Carrier 11 | Toner A | E | |
| Example 12 | 12-A | Carrier 12 | Toner A | E | |
| Example 13 | 13-A | Carrier 13 | Toner A | E | |
| Example 14 | 14-A | Carrier 14 | Toner A | E | |
| Example 15 | 15-A | Carrier 15 | Toner A | E | |
| Example 16 | 16-A | Carrier 16 | Toner A | E | |
| Example 17 | 17-A | Carrier 17 | Toner A | E | |

Example 18

The developing agent 1-A prepared in Example 1 was set in the developing unit 105D of FIG. 5 and a text chart (one character having a size of about 2 mm×2 mm) having an image area of 5 percent was output with a run length of 100,000. The output text charts were evaluated in the following manner. The developing unit 105D had the same configuration as the developing device illustrated in FIGS. 9-11 but the none of the developing units 105A-105C was used. In addition, so-called trickle developing method in which residual developing agent is removed and toner and carrier were replenished into the developing agent conveyor path of the developing device was not used.

Evaluation Method

Durability and color contamination were evaluated in the same manner as in Example 1. In addition, image quality stability during continuous output was evaluated in the following manner.

Image Quality Stability During Continuous Output

The image quality stability during continuous output was evaluated in the following manner. A solid image was continuously output on 10 A4 sheets and the image on the first sheet and the image on the tenth sheet were compared to visually check the degree of image unevenness of the tenth image to the first image. The evaluation criteria are as follows:

G (Good): no image unevenness visually confirmed

M (Marginal): image unevenness worsened but tolerable

P (Poor): image unevenness apparently worsened and intolerable

Examples 19 to 21

The same evaluation was respectively conducted in Examples 19 to 21 as in Example 18 except that the developing agent 1-B, the developing agent 1-C, and the developing agent 1-D prepared by using the developing agent 1-B, the developing agent 1-C, and the developing agent 1-D.

Examples 22 to 34 and Comparative Examples 4 to 6

The same evaluation was respectively conducted in Examples 22-34 and Comparative Examples 4-6 as in Example 18 except that the developing agent 2-A to 17-A, prepared by using the carriers 2-17, was used instead.

Example 35

So-called trickle developing method in which residual developing agent is removed and toner and carrier are replenished into the developing agent conveyor path of a developing device was used in combination in Example 35 and evaluation was conducted in the same manner as in Example 18.

The replenishing toner for development for use in the trickle developing method was prepared by reversing the ratio of the toner and the carrier in the developing agent 1-A.

The evaluation results of the combinations of the carriers and the toners of Examples and Comparative Examples are shown in Table 3.

TABLE 3

| | Developing Agent | Carrier | Toner | Replenishing toner | Durability (charging) Before output [μC/g] | After output [μC/g] | Reduction amount [μC/g] | Durability (resistance value) Change amount [(log)Ω · cm] |
|---|---|---|---|---|---|---|---|---|
| Example 18 | 1-A | Carrier 1 | Toner A | Toner A | −28 | −25 | 3 | 0.7 |
| Example 19 | 1-B | Carrier 1 | Toner B | Toner B | −25 | −21 | 4 | 0.6 |
| Example 20 | 1-C | Carrier 1 | Toner C | Toner C | −26 | −23 | 3 | 0.8 |
| Example 21 | 1-D | Carrier 1 | Toner D | Toner D | −29 | −25 | 4 | 0.6 |
| Example 22 | 2-A | Carrier 2 | Toner A | Toner A | −24 | −18 | 7 | 0.8 |
| Example 23 | 3-A | Carrier 3 | Toner A | Toner A | −31 | −28 | 3 | 0.8 |
| Example 24 | 4-A | Carrier 4 | Toner A | Toner A | −24 | −20 | 4 | 0.8 |
| Comparative Example 4 | 5-A | Carrier 5 | Toner A | Toner A | −22 | −18 | 4 | 0.9 |
| Comparative Example 5 | 6-A | Carrier 6 | Toner A | Toner A | −25 | −11 | 14 | 1.2 |
| Example 25 | 7-A | Carrier 7 | Toner A | Toner A | −30 | −21 | 9 | 1.1 |
| Comparative Example 6 | 8-A | Carrier 8 | Toner A | Toner A | −33 | −28 | 5 | 1.5 |
| Example 26 | 9-A | Carrier 9 | Toner A | Toner A | −28 | −25 | 3 | 0.6 |
| Example 27 | 10-A | Carrier 10 | Toner A | Toner A | −29 | −25 | 4 | 0.8 |
| Example 28 | 11-A | Carrier 11 | Toner A | Toner A | −24 | −19 | 5 | 0.3 |
| Example 29 | 12-A | Carrier 12 | Toner A | Toner A | −23 | −15 | 8 | 1.3 |
| Example 30 | 13-A | Carrier 13 | Toner A | Toner A | −25 | −21 | 4 | 1.0 |
| Example 31 | 14-A | Carrier 14 | Toner A | Toner A | −29 | −25 | 4 | 0.8 |
| Example 32 | 15-A | Carrier 15 | Toner A | Toner A | −27 | −23 | 4 | 0.9 |
| Example 33 | 16-A | Carrier 16 | Toner A | Toner A | −29 | −26 | 3 | 1.0 |
| Example 34 | 17-A | Carrier 17 | Toner A | Toner A | −22 | −14 | 8 | 1.1 |
| Example 35 | 1-A | Carrier 1 | Toner A | Toner A Carrier 1 | −28 | −26 | 2 | 0.5 |

| | Developing Agent | Carrier | Toner | Replenishing toner | Color contamination ΔE (rating) | Continuous output image stability Visual check (rating) | Note |
|---|---|---|---|---|---|---|---|
| Example 18 | 1-A | Carrier 1 | Toner A | Toner A | E | G | |
| Example 19 | 1-B | Carrier 1 | Toner B | Toner B | E | M | Because of black toner, E value was low, |

TABLE 3-continued

| | | | | | | | |
|---|---|---|---|---|---|---|---|
| | | | | | | | color contamination restraint not apparent |
| Example 20 | 1-C | Carrier 1 | Toner C | Toner C | E | G | |
| Example 21 | 1-D | Carrier 1 | Toner D | Toner D | E | G | |
| Example 22 | 2-A | Carrier 2 | Toner A | Toner A | G | G | |
| Example 23 | 3-A | Carrier 3 | Toner A | Toner A | E | G | |
| Example 24 | 4-A | Carrier 4 | Toner A | Toner A | G | G | |
| Comparative Example 4 | 5-A | Carrier 5 | Toner A | Toner A | P | G | |
| Comparative Example 5 | 6-A | Carrier 6 | Toner A | Toner A | P | G | |
| Example 25 | 7-A | Carrier 7 | Toner A | Toner A | E | G | |
| Comparative Example 6 | 8-A | Carrier 8 | Toner A | Toner A | G | G | |
| Example 26 | 9-A | Carrier 9 | Toner A | Toner A | E | G | |
| Example 27 | 10-A | Carrier 10 | Toner A | Toner A | G | G | |
| Example 28 | 11-A | Carrier 11 | Toner A | Toner A | E | G | |
| Example 29 | 12-A | Carrier 12 | Toner A | Toner A | E | M | |
| Example 30 | 13-A | Carrier 13 | Toner A | Toner A | E | G | |
| Example 31 | 14-A | Carrier 14 | Toner A | Toner A | E | G | |
| Example 32 | 15-A | Carrier 15 | Toner A | Toner A | E | G | |
| Example 33 | 16-A | Carrier 16 | Toner A | Toner A | E | G | |
| Example 34 | 17-A | Carrier 17 | Toner A | Toner A | E | G | |
| Example 35 | 1-A | Carrier 1 | Toner A | Toner A Carrier 1 | E | G | |

As seen in the evaluation results shown in Tables 2 and 3, according to the present disclosure, color contamination little or never occurs even for an extended period of use so that the image quality is stable.

According to the present disclosure, it is possible to suppress occurrence of contamination to toner caused by thick black color of carbon black even if the coating layer is scraped off little by little over an extended period of use because the coating layer is not easily scraped off due to the presence of the inorganic particulate B while utilizing the excellent resistance adjusting feature of carbon black.

Having now fully described embodiments of the present invention, it will be apparent to one of ordinary skill in the art that many changes and modifications can be made thereto without departing from the spirit and scope of embodiments of the invention as set forth herein.

What is claimed is:

1. A carrier comprising:

a core material particle comprising a magnetic material; and a coating layer disposed on a surface of the core material particle, the coating layer comprising a resin, carbon black, an inorganic particulate A, and an inorganic particulate B, wherein the carbon black has a concentration gradient along a thickness direction of the coating layer with a concentration from high to low toward a surface of the coating layer, wherein the inorganic particulate A has a concentration gradient along a thickness direction of the coating layer with a concentration from low to high toward the surface of the coating layer, wherein a volume ratio of the carbon black is 0 to 30 percent at a depth range of 0.0 to 0.1 μm from the surface of the coating layer, wherein the inorganic particulate A is electroconductive with a powder specific resistance of 200 Ω·cm or less, and wherein the inorganic particulate A is:

(i) a compound in which tin oxide is doped with tungsten, indium, phosphorus, or an oxide thereof, or tungsten, indium, phosphorus, or the oxide thereof is doped with tin oxide, or (ii) an inorganic particulate having the compound of (i) disposed on a surface of a base of the inorganic particulate.

2. The carrier according to claim 1, wherein a diameter D of the inorganic particulate B and an average thickness T of the coating layer satisfy the following relation:

$$D/2 \leq T \leq D.$$

3. A developing agent comprising:

toner; and the carrier of claim 1.

4. The developing agent according to claim 3, wherein the toner is negatively-charged toner and wherein the inorganic particulate B comprises an inorganic particulate of barium sulfate, zinc oxide, magnesium oxide, magnesium hydroxide, or hydrotalcite.

5. An image forming apparatus comprising:

an image bearer configured to bear a latent electrostatic image;

a latent electrostatic image forming device configured to form the latent electrostatic image;

a developing device comprising the developing agent of claim 3, and configured to develop the latent electrostatic image with the developing agent to form a visible image;

a transfer device configured to transfer the visible image from the image bearer onto a recording medium; and a fixing device configured to fix the visible image transferred from the image bearer on the recording medium.

6. An image forming method comprising:

forming a latent electrostatic image on a latent electrostatic image bearer, and developing the latent electrostatic image with the developing agent of claim 3.

7. The image forming method according to claim 6, further comprising developing a latent image on a surface of a latent image bearer at a site where the latent image bearer faces a developing agent bearer bearing the developing agent on a surface of the developing agent bearer with toner supplied to the latent image on the surface of the latent image bearer, supplying the developing agent to the developing agent bearer by conveying the developing agent along an axis direction of the developing agent bearer, conveying the developing agent retrieved from the developing agent bearer downstream of a site facing the latent image bearer along the axis direction of the developing agent bearer in a same direction as in the step of supplying, and supplying residual developing agent not used in the developing but conveyed to farthest downstream in the conveying direction in the step of supplying and the developing agent retrieved from the developing agent bearer and conveyed farthest downstream in the conveying direction in the step of conveying to the step of developing by conveying the residual developing agent and the developing agent retrieved from the developing agent bearer along the axis direction of the developing agent bearer in an opposite direction to the same direction as in the step of the supplying while stirring the residual developing agent and the developing agent retrieved from the developing agent bearer.

8. A process cartridge comprising:

a container; and the developing agent of claim 3 accommodated in the container.

9. The carrier according to claim 1, wherein the inorganic particulate A is:

(i) a compound in which tin oxide is doped with tungsten, indium, phosphorus, or an oxide thereof or tungsten, indium, phosphorus, or the oxide thereof is doped with tin oxide.

10. The carrier according to claim 1, wherein the inorganic particulate A is:

(ii) an inorganic particulate having the compound of (i) disposed on a surface of a base of the inorganic particulate.

* * * * *